US006577836B2

(12) United States Patent
Yamashita et al.

(10) Patent No.: US 6,577,836 B2
(45) Date of Patent: Jun. 10, 2003

(54) IMAGE-FORMING APPARATUS AND FIXING UNIT WITH HEAT CIRCULATOR FOR HIGH HEAT EXCHANGE EFFICIENCY

(75) Inventors: Takayuki Yamashita, Nakai-machi (JP); Tsukasa Matsuda, Nakai-machi (JP); Tetsuo Yamada, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/951,606

(22) Filed: Sep. 14, 2001

(65) Prior Publication Data

US 2002/0039503 A1 Apr. 4, 2002

(30) Foreign Application Priority Data

Sep. 21, 2000 (JP) ..... 2000-286605

(51) Int. Cl.[7] ..... G03G 15/16; G03G 15/20
(52) U.S. Cl. ..... 399/307
(58) Field of Search ..... 399/91, 94, 159, 399/162, 302, 307, 308

(56) References Cited

U.S. PATENT DOCUMENTS 5,835,830 A * 11/1998 Fukuda et al. ..... 399/307
5,933,694 A * 8/1999 Yamashita et al. ..... 399/307 X
6,088,565 A * 7/2000 Jia et al. ..... 399/302
6,259,880 B1 * 7/2001 Jia et al. ..... 399/307

FOREIGN PATENT DOCUMENTS

| | | |
|---|---|---|
| JP | 58-36341 | 8/1983 |
| JP | 59-129888 | 7/1984 |
| JP | 62-95568 | 5/1987 |
| JP | 4-298777 | 10/1992 |
| JP | 10-213977 | 8/1998 |

* cited by examiner

*Primary Examiner*—Sandra Brase
(74) *Attorney, Agent, or Firm*—Oliff & Berridge, PLC

(57) ABSTRACT

An image-forming apparatus, a fixing unit and a heat circulation system are equipped with a heat circulator capable of being fabricated at low costs and ensuring high heat exchange efficiency. The heat circulator includes two tabular metal members that come into contact with an intermediate transfer member at positions upstream and downstream of a simultaneous transfer and fixing zone, and plural heat pipes that transfer the heat of the first metal member to the second metal member.

8 Claims, 15 Drawing Sheets

CONVENTIONAL ART

CONVENTIONAL ART

CONVENTIONAL ART

IMAGE-FORMING APPARATUS AND FIXING UNIT WITH HEAT CIRCULATOR FOR HIGH HEAT EXCHANGE EFFICIENCY

BACKGROUND OF THE INVENTION

1. Field of the Invention

The present invention relates to an image-forming apparatus and a fixing unit used in electrophotographic copying machines, printers, etc.

2. Description of the Related Art

Heretofore, an image-forming apparatus is widely used in electrophotographic copying machine and printers, in which an electrostatic latent image is formed on a photoreceptor, it is developed with a dry toner, and the resulting toner image is electrostatically transferred onto a recording medium and fixed thereon. In the image-forming apparatus, however, recording paper, a type of recording medium could not be kept in tight contact with the photoreceptor owing to its surface roughness, and often forms some uneven gaps between them, whereby the transfer field around the recording paper will be disordered and the toner grains thereon will produce Coulomb repulsion. One problem with it is that the image formed on the recording paper is thereby often disordered to cause image deletion or noise.

To solve the problem, some advanced types of image-forming apparatus have been proposed. In one type of the apparatus for image formation, plural toner images of different colors are electrostatically transferred onto an intermediate transfer member to form a multi-layer toner image thereon, then the multi-color multi-layer toner image is fed on the member, and the thus-fused multi-layer toner image is transferred and simultaneously fixed on a recording medium in a predetermined simultaneous transfer and fixing zone to thereby form a color image on the recording medium, and in another type, the toner image formed on an endless photoreceptor is fused thereon, and is then transferred and fixed on a recording medium.

In these types of image-forming apparatus, the toner image is non-electrostatically transferred onto the recording medium and will be therefore free from the problem of image quality deterioration noted above. In these, however, the part of the intermediate transfer member and that of the photoreceptor which are directly or indirectly kept in contact with a photoreceptor cleaner and a development unit must be cooled to a temperature not higher than melting temperature of the toner, in order that the toner in the photoreceptor cleaner and in the development unit is prevented from melting therein. To meet the requirement, another type of image-forming apparatus is disclosed, for example, in Japanese Patent Laid-Open Nos. 12988/1984 and 95568/1987, in which a forcedly or spontaneously cooling member is disposed in the traveling route of the intermediate transfer member and the photoreceptor along which the intermediate transfer medium with a toner image formed thereon passes through the simultaneous transfer and fixing zone to reach the photoreceptor cleaner and the development unit, or the traveling route of the two is prolonged to ensure a prolonged cooling time for the two.

However, in the image-forming apparatus of that type, the intermediate transfer medium and the photo or cooled to a temperature not higher than the melting temperature of the toner must be re-heated up to the temperature necessary for transfer and fixation in every image formation cycle, and this carries another problem as requiring large power.

To solve the problem Japanese Patent Publication No. 36341/1983 discloses a modified image-forming apparatus in which the heat capacity of the intermediate transfer member is limited to at most $3.1\times10^{13}$ cal/cm$^{2}$·° C. to thereby reduce the heat energy necessary for heating the member in every image formation cycle. To reduce the heat capacity of the belt in the apparatus, in general, the belt is thinned. However, the belt could not be thinned so much so as not to reduce its strength. The belt not so much thinned to have a practicable thickness could not attain a significant result. A metallic belt may be employed to reduce its thickness without lowering its strength, but this is electroconductive and is therefore problematic in that it could not apply to an ordinary electrostatic transfer system widely used for forming a toner image on an intermediate transfer member. Another method may be employed that includes applying pressure to an intermediate transfer member for forming a toner image thereon. However, this is problematic in that, when high pressure is applied to the member, the apparatus shall be complicated and large-sized.

On the other hand, Japanese Patent Laid-Open No. 298777/1992 discloses an image-forming apparatus in which the belt running toward the image-forming zone and the belt running toward the simultaneous transfer and fixing zone are contacted with each other for heat exchange therebetween in the region between the image-forming site of a belt-like image bearing member and the simultaneous transfer and fixing zone, to thereby reduce the energy loss in that region of the apparatus.

In the image-forming apparatus of that type, however, the two belts are directly contacted with each other and therefore require an additional urging member to press the belts against each other. In this, the urging member is provided above the surface of the upper belt, and it will scratch the surface of the belt to worsen the quality of the images formed. In addition, since the belts are contacted with each other, they must be elastic and require a space in which they are warped before and after they are contacted with each other. This is problematic as the apparatus must be large-sized. Moreover, since the belts are insulators, they are electrostatically charged when contacted with each other. Therefore, their adhesion to each other will be good to enhance beat exchange between them, but the belts could not well run and will often cause image registration failure and other image defects. This is still another problem with the image-forming apparatus.

To solve these problems, a heat conductor may be disposed between a part of the belt running toward the image-forming zone and a part thereof running toward the simultaneous transfer and fixing zone for attaining heat exchange between the two parts of the belt. However, merely disposing such a heat conductor between the parts of the belt would average the temperatures of those parts, but could not attain sufficient heat energy exchange between them, and the heat exchange efficiency of this system will be low.

To solve this problem, Japanese Patent Laid-Open No. 213977/1998 discloses an image-forming apparatus in which a heat circulator is disposed between a part of the belt running toward the image-forming zone and a part thereof running toward the simultaneous transfer and fixing zone. The heat circulator is directly contacted with the two parts of the belt to attain heat exchange between them, and this prevents the tempts of the two parts of the belt from being averaged, and therefore realizes high heat exchange efficiency. Precisely, the heat circulator includes plural metal members aligned perpendicularly to the traveling direction of the belt both on the side of the belt that runs toward the image-forming zone and on the other side thereof that runs toward the simultaneous transfer and fixing zone, and heat pipes that connect these plural metal members. In his, the neighboring plural metal members are bonded to each other via a heat-insulating spacer therebetween.

However, the heat circulator carries some problems mentioned below. Specifically, in the heat circulator, the neighboring plural metal members are connected with each other via a heat-insulating spacer therebetween. Therefore, in order that the heat circulator has satisfactory mechanical strength, the side surface area of each metal member must be enough to connect the neighboring metal members to each other, and too small metal members could not satisfy the requirement. As a result, it is inevitable to enlarge the heat circulator, and cutting the cost for producing the heat circulator will be difficult. In addition, in order that the heat circulator attains efficient heat exchange between the two parts of the running belt while it is kept in contact with them, the heat circulator must be well polished to have an accurately curved surface with no roughness. However, since the metal members are connected to construct the heat circulator, a difference in level between the connected metal members will he inevitable. Therefore, it will take a lot of time and will be expensive to accurately construct the heat circulator, and the cost for producing the heat circulator will be high.

FIG. 15 shows one example of the conventional heat circulator to be in an image-forming apparatus.

As in FIG. 15, the conventional heat circulator includes a heat-receiving part 11 composed of plural metal members 22 that are aligned in parallel with each other but perpendicularly to the belt-traveling direction A, a heat-radiating part 12 also composed of plural metal members 22 that are aligned in parallel with each other but perpendicularly to the belt-traveling direction A, and plural, closed cylindrical heat pipes 13 that connect the metal members 22 of the heat-receiving part 11 to those of the heat-radiating part 12.

The heat-receiving part 11 is disposed at the position at which it is contacted with a hot part 21*a* of the belt moving and circulating in the direction A, and this receives the heat from the hot belt part 21*a,* and transfers the heat to the heat-radiating part 12 disposed at the position at which it is contacted with a low-temperature part 21*b* of the other belt, via the heat pipes 13.

The metal members 22 are made of a heat-conductive metal such as aluminium, copper or their alloy, but it is said that an extrusion molding of aluminium or an aluminium alloy is preferred for them as being inexpensive and well workable.

FIG. 16A and FIG. 16B are to show the outline of the metal members for the heat circulator shown in FIG. 15; and FIG. 17 is a perspective view of one metal member shown in FIG. 16A and FIG. 16B.

As in FIG. 16A and FIG. 16B, the heat-receiving part 11 and the heat-radiating part 12 each include plural metal members 22 aligned in parallel with each other but perpendicularly to the belt-traveling direction A, and every metal member 22 has a through-hole 23 that runs in the direction of the width of the belt. The both side surfaces of every metal member 22 are worked to have a groove 24 that runs in the direction of the width of the belt.

A straight part 13*a* of the heat pipe 13 is inserted into the through-hole 23. Every through-hole 23 is so formed that it is spaced from the back surface of each metal member 22 by the same depth d. With all through-holes 23 being so disposed, the straight part 13*a* of every beat pipe to be inserted into each through-hole 23 may have the same size, and this increases the working efficiency in fabricating the heat circulator.

The grooves 24 are to enhance the heat insulation between the neighboring metal members 22 and to reduce the weight of the heat circulator. The neighboring metal members 22 are spaced from each other by a distance of from 0.05 mm to 2.0 mm therebetween, and are integrally bonded to each other via brazed joints 25.

As in FIG. 17, the brazed joints 25 are formed partly only at the both edges of the metal member, concretely around the upper edges and the lower edges of the side surface of the metal member not brought into contact with a belt, and the brazed area will be about 40 $mm^2$ or so in total.

FIG. 18 shows an outline of the constitution of an image-forming apparatus with the conventional heat circulator built therein.

In the image-forming apparatus illustrated, a toner image is formed on the surface of a belt 21 in the image-forming region (not shown), and the belt 21 thus carrying the toner image formed thereon moves in the direction of the arrow A. When the belt 21 has reached the beat-radiating part 12 of a heat circulator 20, it is heated by the plural metal members 22 in the heat-radiating part 12, then further heated by a heating plate 9, and thereafter still further heated under pressure between a heating roll 2 and a pressure roll 3 in a subsequent simultaneous transfer and fixing zone F. Through the process, the toner image thus carried by the belt 21 is transferred and fixed on a recording medium The belt 21 thus heated in the simultaneous transfer and fixing zone F and therefore having a high temperature is then brought into contact with the plural metal members 22 in the heat-receiving part 11 of the heat circulator 20, and is thus gradually cooled through heat exchange between them. The thus-cooled belt 21 further circulates and moves in the direction of the arrow A, and then a toner image is again formed on its surface in the image-forming region (not shown). With the toner image formed thereon, the belt 21 further runs toward the heat-radiating part 12 of the heat circulator 20.

On the other hand, the plural metal members 22 in the heat-receiving part 11 that have received the heat from the belt 21 transfer the heat to the plural metal members 22 in the heat-radiating part 12 via the heat pipes 13, and the plural metal members 22 in the heat-radiating part 12 transfer the heat to the belt 21 having a low temperature.

The neighboring metal members 22 in the heat-receiving part 11 and those in the heat-radiating part 12 are thermally insulated from each other. Therefore, the high-temperature metal members in the heat-receiving part 11 are kept still having a high temperature also in the heat-radiating part 12, and the two parts realize high heat-exchange efficiency.

Back surfaces 11*b,* 12*b* of the metal members 22 in the heat-receiving part 11 and the heat-radiating part 12 that are not brought into contact with the belt 21 are finished to be nearly flat, as in FIG. 16A; but outer surfaces 11*a* and 12*a* thereof that are brought into contact with the belt 21 are cut and polished to have a gently curved profile having a radius of curvature of from 300 mm to 2000 mm or so in order to ensure good contact between the surface and the belt 21. While their surfaces are cut and polished, the metal members 22 are so controlled that the surface level difference between the neighboring metal members 22 could be at most 100 $\mu$m. If the surface level difference is larger than 100 $\mu$m, the belt 21 could not be well kept in contact with the metal members 22, and if so, the heat-exchange efficiency between them will greatly lower. Therefore, it is extremely important to minimize the surface level difference between the neighboring metal members 22.

However, while their surfaces are cut and polished, the metal members must be prevented as much as possible from being thermally expanded owing to the temperature increase during the process of working them and must be prevented as much as possible from being deformed owing to the stress that they will receive while worked. The working process requires the utmost care, and will often take one full day or so. For these reasons, constructing the heat circulator takes a lot of time and much labor, and the heat circulator thus constructed is expensive.

The problems noted above also apply to the case of disposing the heat circulator in a fixing unit to be used in electrophotographic image formation. For example, a fixing unit of a type in which a recording medium with a toner image formed thereon is, while put on a circulating endless belt-type fixing member, passed through a fixing zone including a heating roll and a pressure roll so that the toner image is fixed on the recording medium under heat and pressure in that zone will carry various problems such as those noted above, when it is provided with a heat circulator of a type that is kept in contact with the fixing member at positions both upstream and downstream the fixing zone so that the heat circulator can transfer the heat of the fixing member downstream of the fixing zone to the part of the fixing member upstream of the fixing zone.

SUMMARY OF THE INVENTION

The present invention has been made in view of the above circumstances, and provides an image-forming apparatus equipped with a heat circulator that achieves high heat exchange efficiency and is inexpensive, and also provides a fixing unit quipped with such a heat circulator.

Specifically, the first aspect of the invention is to provide an image-forming apparatus which includes an endless image bearing member that moves while carrying a toner image formed thereon; a heating unit disposed in the traveling route of the image bearing member; a first metal member to come into contact with the image bearing member at a position downstream of the heating unit in the traveling direction of the image bearing member; a second metal member to come into contact with the image bearing member at positions downstream of the first metal member and upstream of the heating unit in the traveling direction of the image bearing member; and plural heat-transporting members aligned in the traveling direction of the image bearing member and clamped between the first and second metal members.

The second aspect of the invention is to provide a fixing unit which includes a movable endless belt; a heating unit to come into contact with the belt to heat it; a first metal member to come into contact with the belt at a position downstream of the heating unit in the traveling direction of the belt; a second metal member to come into contact with the belt at positions of downstream of the first metal member and upstream of the heating unit in the traveling direction of the belt; and plural heat-transporting members aligned in the traveling direction of the belt and clamped between the first and second metal members.

The third aspect of the invention is to provide a heat circulation system which includes a movable endless belt; a heating unit to come into contact with the belt to heat it; a pair of metal members that come into contact with the belt at positions upstream and downstream of the heating unit in the belt traveling direction; and plural heat-transporting members to connect the metal members, and in which the heat of the endless belt downstream the belt of the heating unit in the traveling direction is circulated to the part of the belt upstream of the heating unit.

BRIEF DESCRIPTION OF THE DRAWINGS

Preferred embodiments of the invention will be described in detail based on the following figures, wherein.

DESCRIPTION OF THE PREFERRED EMBODIMENTS

Embodiments of the invention are described below.

Figure 1:
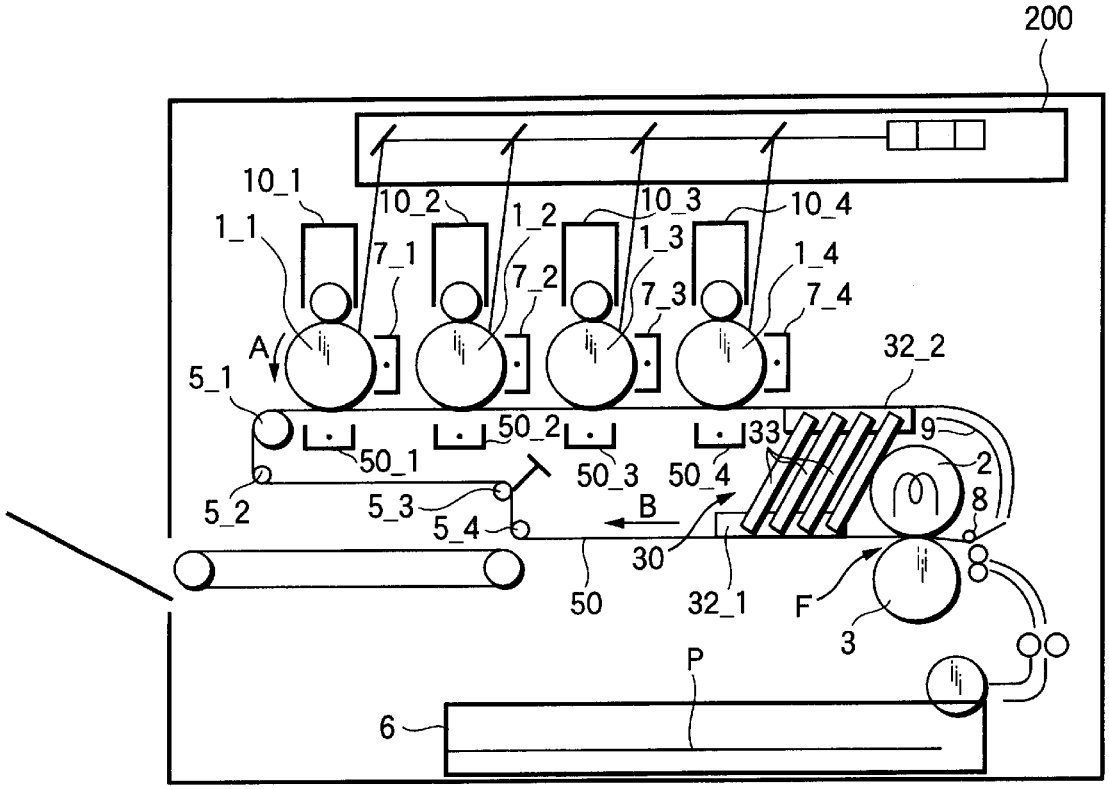
FIG. 1 is a schematic view showing the outline of the constitution of one embodiment of the image-forming apparatus of the invention.

FIG. 1 is a schematic view showing the outline of the constitution of one embodiment of the image-forming apparatus of the invention.

This is to concretely illustrate one embodiment of the image-forming apparatus of the invention.

As in FIG. 1, the image-forming apparatus includes an endless belt-type intermediate transfer member 50 that circulates and moves in the direction of the arrow B, while carrying a toner image on its surface, and transports the toner image to the simultaneous transfer and fixing zone F; a recording medium-transporting system for transporting recording paper P to the simultaneous transfer and fixing zone F in accordance with the timing of the endless belt-type intermediate transfer member 50 to transport the toner image thereon to that zone F; a heating roll 2 and a pressure roll 3 between which the toner image on the intermediate transfer member 50 having been transported to the simultaneous transfer and fixing zone F is heated while the recording paper P having been transported to that zone F is laid over the intermediate transfer member 50 with the toner image being sandwiched therebetween and pressed against the member 50 so that the toner image on the intermediate transfer member 50 is transferred and fixed on the recording paper P; and a heat circulator 30 that comes into contact with the running intermediate transfer member 50 at positions both upstream and downstream of the simultaneous transfer and fixing zone F in the traveling direction of the intermediate transfer member 50 so that the heat of the intermediate transfer member 50 downstream of the simultaneous transfer and fixing zone F is transferred to the part of the intermediate transfer member 50 upstream of that zone F.

The heat circulator 30 includes two tabular metal members 32_1, 32_2 that come into contact with the intermediate transfer member 50 at positins upstream and downstream of the simultaneous transfer and fixing zone F; and plural beat pipes 33 bonded to both the two metal members 32_1, 32_2 and aligned in the longitudinal direction of the intermediate transfer member 50 so that the heat of the first metal member 32_1 disposed downstream of the simultaneous transfer and fixing zone F is transferred to the second metal member 32_2 disposed upstream of that zone Z, and this heat circulator 30 is so controlled that it satisfies the formula (1) to be mentioned hereinunder.

In this embodiment, the intermediate transfer member 50 corresponds to the image bearing member referred to herein; the heating roll 2 and the pressure roll 3 correspond to the simultaneous transfer and fixing system referred to herein; the heat pipes 33 correspond to the heat-transporting members referred to herein; the rolls 5_1, 5_2, 5_3, 5_4, the heating plate 9 and the curvature-reversing roll 8 correspond to the recording medium-transporting system referred to herein; and the recording paper P corresponds to the sheet-like recording medium referred to herein.

In addition, the image-forming apparatus of this embodiment includes four photoreceptors 1_1, 1_2, 1_3, 1_4 for four colors of black, yellow, magenta and cyan, respectively, and these photoreceptors all rotate in the direction of the arrow A. These photoreceptors are all uniformly charged by chargers 7_1, 7_2, 7_3, 7_4, respectively, on their surfaces, and are exposed to the light from the beam scanner 200 that is switched on and off by the beam pulse width modulation unit in accordance with density signals, whereby are formed electrostatic latent images corresponding to the individual colors.

The electrostatic latent images thus formed on the photoreceptors are developed in the developer units 10_1, 10_2, 10_3, 10_4 that contain black, yellow, magenta and cyan toners, respectively, therein, whereby toner images of those colors are formed on the respective photoreceptors each corresponding to the digital image that displays its density through area modulation. These toner images are transferred one after another onto the intermediate transfer member 50 by means of the transfer members 50_1, 50_2, 50_3, 50_4. This is primary image transfer. Through this, a multi-color toner image composed of these toner images of different colors is formed on the intermediate transfer member 50.

Supported by the rolls 5_1, 5_2, 5_3, 5_4, the heating plate 9 and the curvature-reversing roll 8, the intermediate transfer member 50 circulates and moves in the direction of the arrow B.

Held on the intermediate transfer member 50 that moves in the direction of the arrow B, the multi-color toner image reaches the site of the second metal member 32_2 of the heat circulator 30, and is heated by the second metal member 32_2. Then, this reaches the heating plate 9 and is heated by it, and is thus fused. The heating plate 9 is made of a tabular member having a heat source.

The heat circulator 30 includes the tabular second metal member 32_2 that comes into contact with the intermediate transfer member 50 at a position upstream of the simultaneous transfer and fixing zone F; the tabular first metal member 32_1 that comes into contact with the intermediate transfer member 50 at a position downstream of that zone F; and plural heat pipes 33 bonded to both the two metal members 32_1, 32_2 and aligned in the longitudinal direction of the intermediate transfer member 50 so that the heat of the first metal member 32_1 is transferred to the second metal member 32_2.

The first metal member 32_1 of the heat circulator 30 is to receive the heat of the intermediate transfer member 50 running forward from the simultaneous transfer and fixing zone F along with the multi-color toner image formed thereon and along with the recording paper P, and to cool them. With that, the toner is coagulated and solidified to firmly adhere to the recording paper P.

The heat thus having been recovered by the first metal member 32_1 of the heat circulator 30 is then transferred to the second metal member 32_2 via the heat pipes 33 that connect the first metal member 32_1 and the second metal member 32_2, and then returned to the intermediate transfer member 50 via the second metal member 32_2. In that manner, the heat of the intermediate transfer member 50 is prevented from being transferred to the photoreceptor cleaner and to the development unit, and therefore the toner is prevented from fusing in the photoreceptor cleaner and in the development unit. In the process, in addition, heat is recovered and recycled in that manner, and the energy necessary in the image-forming cycle can be saved.

The details of the heat circulator 30 will be described hereinunder.

The heating roll 2 and the pressure roll 3 that constitute the simultaneous transfer and fixing system are so disposed that they face each other via the intermediate transfer member 50 passing between them. In this embodiment of the invention, the pressure roll 3 is so positioned that it comes into contact with the toner image-carrying surface of the intermediate transfer member 50; and the heating roll 2 is so positioned that it comes into contact with the back surface of the intermediate transfer member 50. Contrary to this, however, the heating roll 2 and the pressure roll 3 may be positioned in the other way around. If desired, a heat source may be additionally disposed inside the pressure roll 3.

After the intermediate transfer member 50 carrying the multi-color toner image on its surface has come into contact with the heating plate 9 to be heated by it, it is conveyed to the nip area formed by the heating roll 2 and the pressure roll 3. In accordance with the timing of the multi-color toner image conveyed to the nip area formed by the heating roll 2 and the pressure roll 3, recording paper P is conveyed to the nip area from the tray 6. The intermediate transfer member 50 carrying the multi-color toner image on its surface and the recording paper P are thus heated under pressure between the heating roll 2 and the pressure roll 3. In this stage, the toner thus heated up to a temperature not lower than its melting temperature softens, fuses, then penetrates into the recording paper P, and thereafter solidifies, whereupon the multi-color toner image is transferred from the intermediate transfer member 50 to the recording paper P and is fixed on the recording paper P. This is secondary image transfer.

The intermediate transfer member 50 cooled by the first metal member 32_1 of the heat circulator 30 is, along with the recording paper P, further conveyed in the direction of the arrow B, and the two reach the roll 5_4 having a small radius of curvature. As being pliable and tough, the recording paper P is then separated from the intermediate transfer member 50, and has a color image formed thereon. The surface of the toner image transferred and fixed on the recording paper P follows the surface of the intermediate transfer member 50, and the image formed on the recording paper is therefore smooth and glossy.

For the photoreceptors 1_1, 1_2, 1_3, 1_4 in this embodiment, usable are any of inorganic photoreceptors of Se, a-Si, a-SiC, CdS or the like, or organic photoreceptors.

For the toners, usable are any known materials of thermoplastic binders containing dyes of yellow, magenta, cyan, etc. In this embodiment, the toners used have a weight-average molecular weight (Mw) of 54000, a melting temperature (Tm) of 120° C., and a viscosity ($\eta$) at the melting temperature of 4000 Pas. The mean grain size of the toners is 7 $\mu$m. The condition for exposure and development is so controlled that the toner dose of each color to recording paper could fall nearly between 0.4 mg/cm$^2$ and 0.7 mg/cm$^2$, depending on the dye content of each toner. In this embodiment, the toner dose of each color is 0.65 mg/cm$^2$.

The intermediate transfer member 50 has a two-layered structure composed of a base layer and a surface layer, and its width is 340 mm. The base layer is made of a polyimide film containing carbon black and having a thickness of 80 $\mu$m. In this embodiment, the volume resistivity of the base layer is controlled to be $10^{10}$ Ωcm by controlling the carbon black content thereof. This is for electrostatically transferring the toner images from the photoreceptors onto the intermediate transfer member with no image disarray. The base layer may be a highly heat-resistant sheet having, for example, a thickness of from 10 $\mu$m to 300 $\mu$m. For this, usable are polymer sheets of polyester, polyethylene terephthalate, polyether sulfone, polyether ketone, polysulfone, polyimide, polyimidamide, polyamide, etc. The volume resistivity of the surface layer is controlled to be $10^{14}$ Ωcm. This is for electrostatically transferring the toner images from the photoreceptors onto the intermediate transfer member with no image disarray. In addition, for increasing the adhesiveness between the intermediate transfer medium and the recording paper with the toner images being sandwiched therebetween when the toner images are transferred from the intermediate transfer member onto the recording paper and are simultaneously fixed thereon, the surface layer is made of a silicone copolymer having a rubber hardness of 30 degrees and a thickness of 50 $\mu$m. The silicone copolymer is elastic, and its surface is adhesive to toner at room temperature. In addition, it releases fused and fluidized toner with ease, and therefore ensures efficient transfer of toner to a recording medium. As having such characteristics, the silicone copolymer is the most favorable to the surface layer.

The heating plate 9 is made of an aluminium sheet with silicone rubber heater adhered to its back surface. It has a thickness of 2 mm and a length in the intermediate transfer member-traveling direction of 220 mm. The temperature of the heating plate 9 is so defined and controlled that the toner temperature in the region in which the intermediate transfer member 50 comes into contact with the recording paper P is not lower than the melting temperature Tm of the toner.

Apart from the above, a ceramic heater may also be used for the heating plate 9.

For the heating roll 2 and the pressure roll 3, usable are metal rolls or metal rolls coated with a heat-resistant elastic layer of silicone rubber or the like.

A heat source is disposed inside the heating roll 2. The temperature of the heating roll 2 is so defined and controlled that the toner temperature in the region heated by the heating roll 2 is not lower than the melting temperature Tm of the toner. In this embodiment, aluminium hollow rolls coated with a 2 mm-thick silicone rubber layer having a hardness of 30 degrees are used for the heating roll 2 and the pressure roll 3. Their outer diameter is 50 mm A halogen lamp is used for the heat source to be inside the heating roll 2.

The nip width formed by the heating roll 2 and the pressure roll 3 is controlled to be 7.0 mm by controlling the pressing force of the pressure roll 3.

The heat circulator used in this embodiment is described below.

Figure 2:
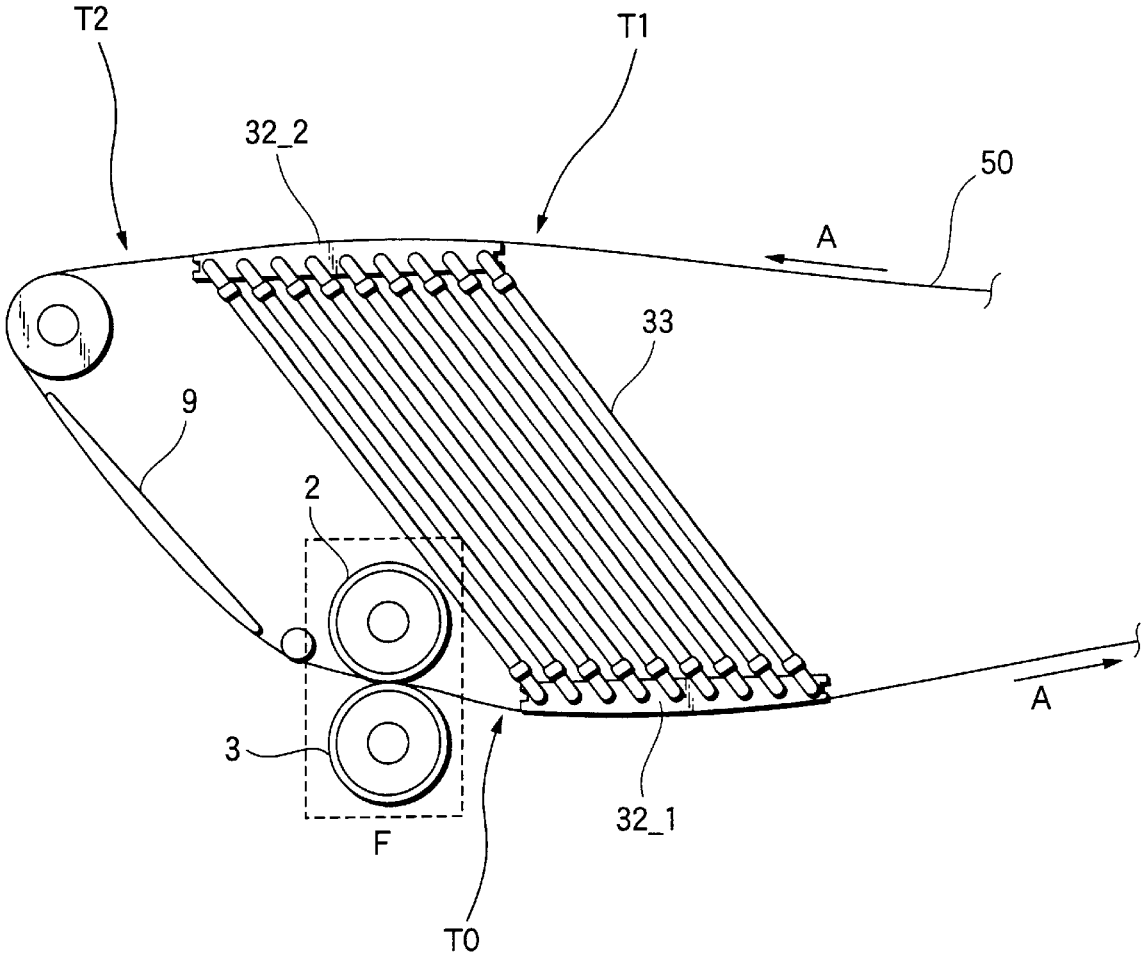
FIG. 2 is a schematic view showing the outline of the constitution of the heat circulation system of the invention built in the image-forming apparatus of FIG. 1.

FIG. 2 is a schematic view showing the outline of the constitution of the heat circulator built in the image-forming apparatus of this embodiment.

In the image-forming apparatus illustrated, a toner image is formed on the surface of the intermediate transfer member 50 in an image-forming region (not shown), and the intermediate transfer member 50 thus carrying the toner image formed thereon is circulated and moved in the direction of the arrow A, and reaches the site of the second metal member 32_2 of the heat circulator 30. With that, the intermediate transfer member 50 is heated by the second metal member 32_2, then further heated by the heating plate 9, and thereafter heated under pressure between the heating roll 2 and the pressure roll 3 in the simultaneous transfer and fixing zone F. Through the process, the toner image carried by the intermediate transfer member 50 is transferred onto a recording medium and fixed thereon.

The intermediate transfer member 50 heated to a high temperature in the simultaneous transfer and fixing zone F is then brought into contact with the first metal member 32_1 and is gradually cooled through heat exchange between the two members. The thus-cooled intermediate transfer member 50 is further circulated and moved in the direction of the arrow A, and a toner image is again formed thereon in the image-forming region (not shown). With that, this further moves toward the second metal member 32_2.

Figure 3:
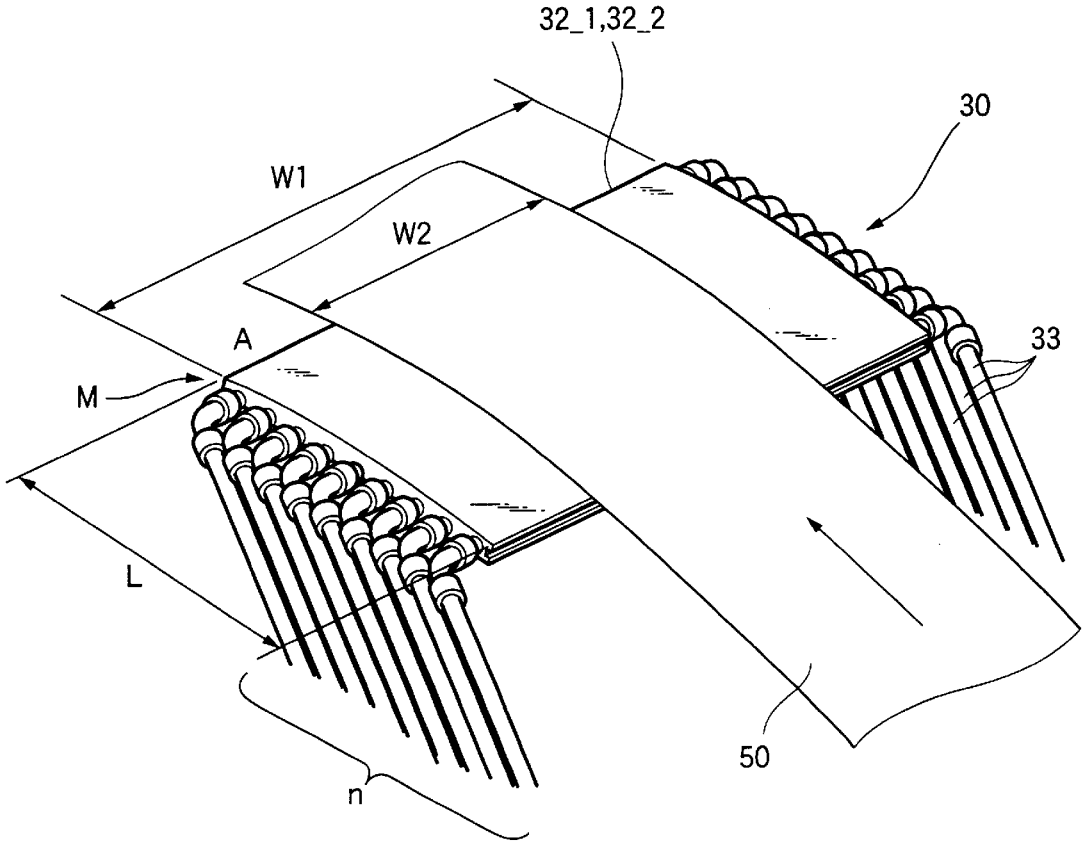
FIG. 3 is a perspective view of the heat circulation system of FIG. 2.
Figure 4:
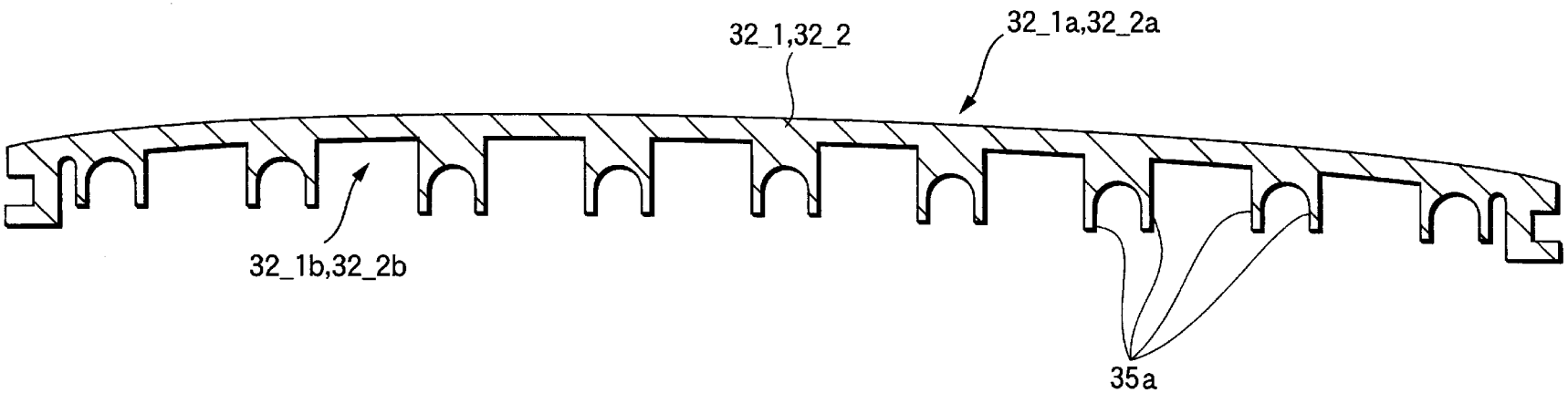
FIG. 4 is a cross-sectional view of the metal member to be in the heat circulation system of FIG. 3, into which heat pipes are not as yet fitted.
Figure 5:
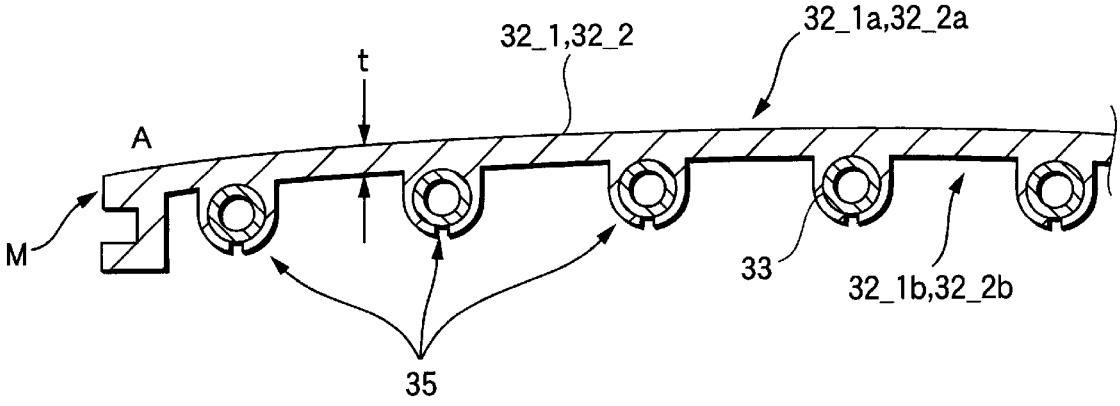
FIG. 5 is a cross-sectional view of the metal member to be in the heat circulation system of FIG. 3, with heat pipes fitted thereinto.
Figure 6:
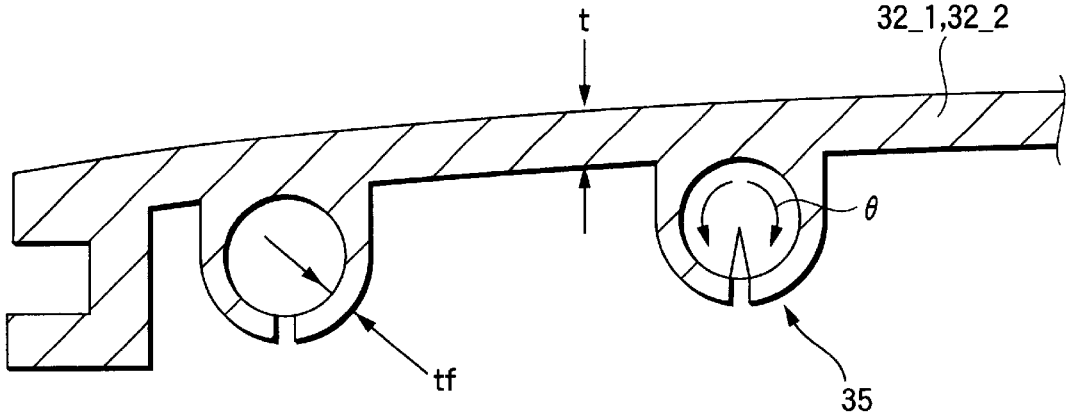
FIG. 6 is a detailed cross-sectional view of the metal member to be in the heat circulation system of FIG. 3, into which heat pipes are not as yet fitted.

FIG. 3 is a perspective view of the heat circulator of FIG. 2; FIG. 4 is a cross-sectional view of the metal member to be in the heat circulator of FIG. 3, into which heat pipes are not as yet fitted; FIG. 5 is a cross-sectional view of the metal member to be in the heat circulator of FIG. 3, with heat pipes fitted thereinto; and FIG. 6 is a detailed cross-sectional view of the metal member to be in the heat circulator of FIG. 3, into which heat pipes are not as yet fitted.

As in FIG. 3, the first metal member 32_1 and the second metal member 32_2 each made of one metal sheet, and both have the same shape. They are connected by plural heat pipes 33 bonded thereto, thereby constituting the beat circulator 30.

In the embodiment illustrated, the metal members 32_1, $32_2$ are made of an extrusion molding of an aluminium alloy (A6063). Apart from it, any other heat-conductive and well-workable materials may be used for the metal members 32_1, 32_2. For example, in addition to the material mentioned above, usable are other aluminium alloys, aluminium, and also copper and copper alloys.

In this embodiment, heat pipes 33 are used for the heat-transporting members. In the heat pipes, liquid is sealed under reduced pressure. Therefore, their heat resistance is extremely small, and the heat pipes can transfer much heat at high speed even though the temperature difference between the members for heat exchange through them is small. In this embodiment, the heat pipes 33 are copper alloy tubes each having a diameter of 9.5 mm in which pure water is scaled. In this, 9 heat pipes of that type are used. In place of such heat pipes, graphite sheets may also be used for the heat-transporting member, for example, as in the other embodiment described hereinunder.

As in FIG. 4 and FIG. 5, the surfaces 32_1*a,* 32_2*a* of the first and second metal members 32_1, 32_2 that come into contact with the intermediate transfer member 50 are slightly so curved in the longitudinal direction of the belt (intermediate transfer member 50) that they ensure good contact with the intermediate transfer member 50. The back surfaces 32_1*b,* 32_2*b* of the metal members 32_1, 32_2 are worked to have pockets 35 all extending in the widthwise direction of the intermediate transfer member 50.

The heat pipes 33 are separately inserted into these pockets 35, and the side walls 35*a* of each pocket 35 of the metal members 32_1, 32_2 arc clamped so that the heat pipes 33 are fixed to the metal members 32_1, 32_2, as in FIG. 5. In the embodiment illustrated, the thickness t of the metal members 32_1, 32_2 is 1.5 mm; the wall thickness tf of the side wall 35*a* of each pocket 35 is 1.5 mm; and the pocket angle θ of each pocket 35 that surrounds the heat pipe 33 is 200 degrees, as in FIG. 6.

Figure 16A:
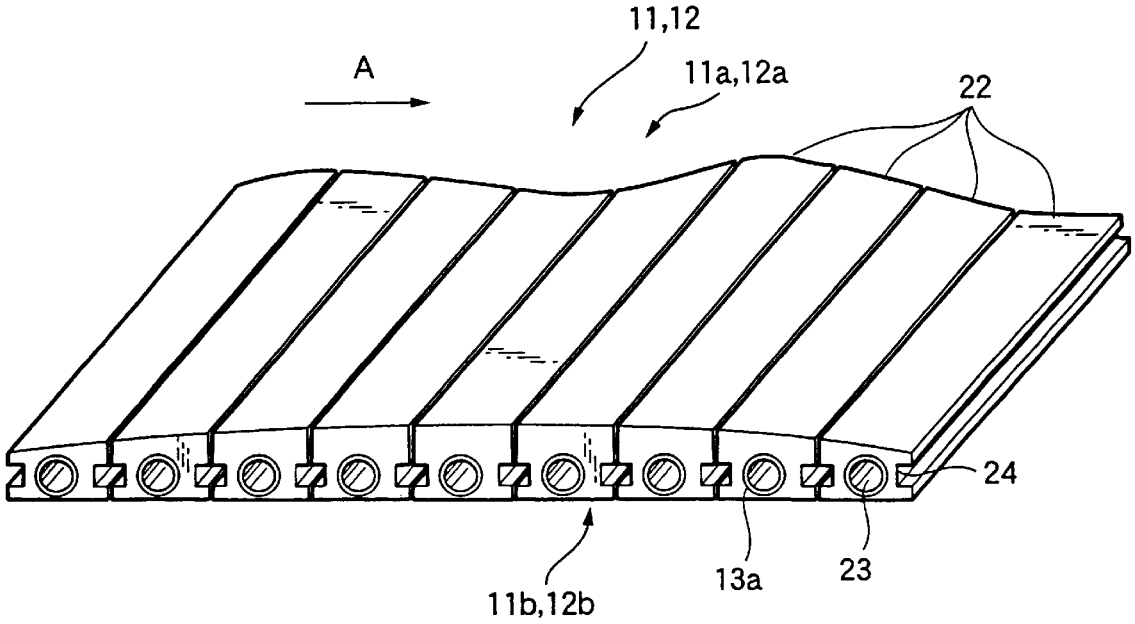
FIG. 16A and FIG. 16B show the outline of the metal members to be in the heat circulator of FIG. 15.
Figure 16B:
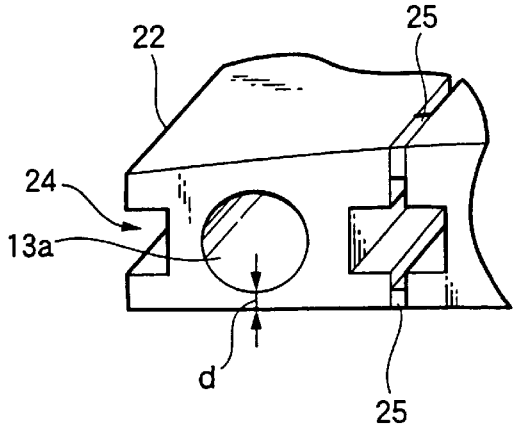
CONVENTIONAL ART FIG.16B
Figure 17:
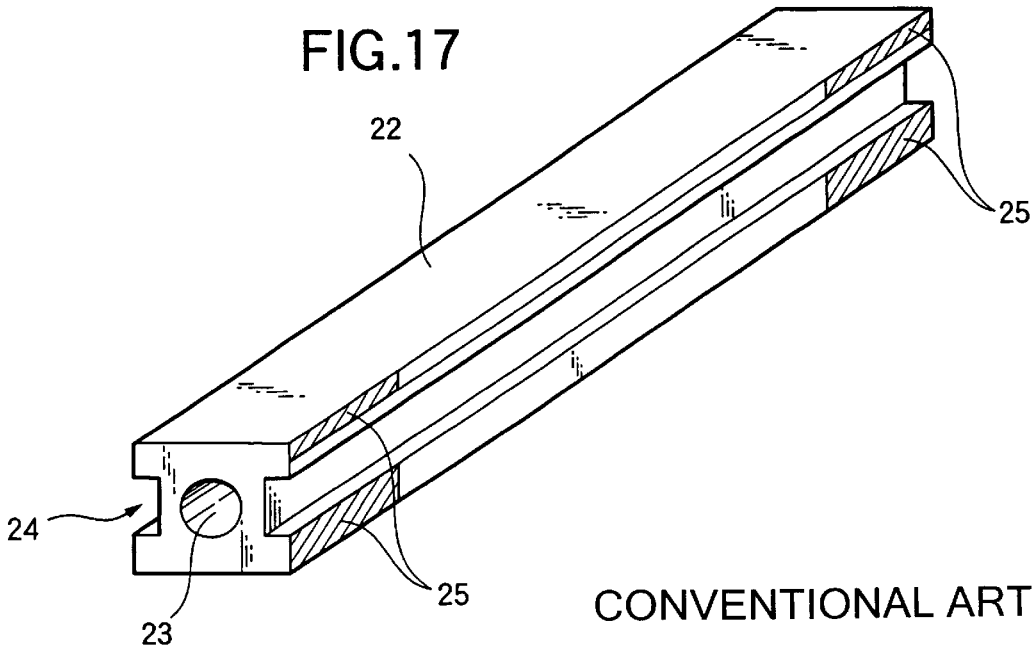
FIG. 17 is a perspective view showing one metal member of FIG. 16A and FIG. 16B.

As described hereinabove, the first metal member 32_1 and the second metal member 32_2 that constitute the heat circulator 30 of this embodiment are both made of a single metal plate, and their constitution basically differs from the conventional constitution composed of plural metal members 22 that are aligned in parallel with each other and are integrated by brazing them (see FIG. 16A and FIG. 16B).

Figure 15:
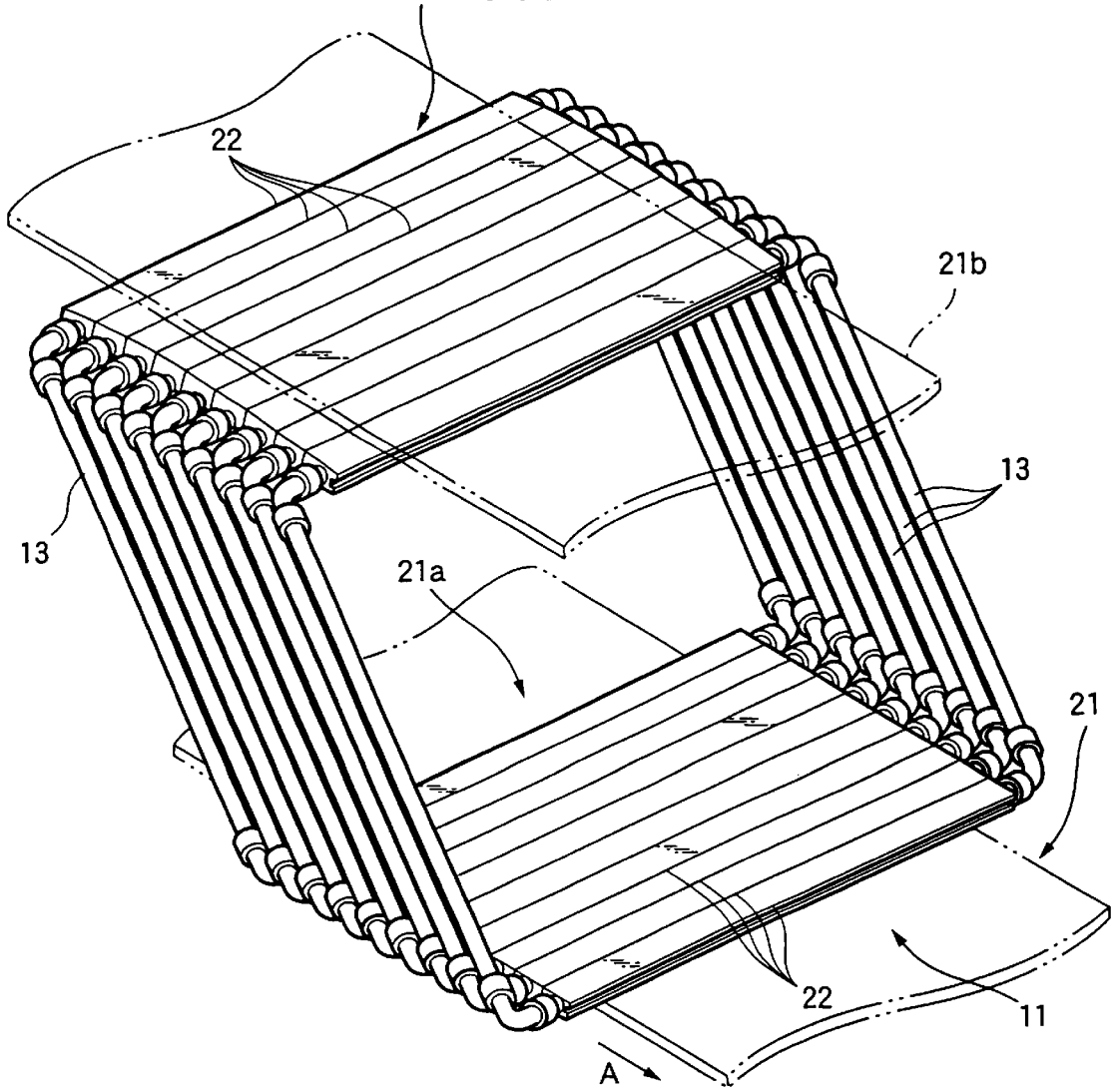
FIG. 15 is a perspective view showing the outline of the constitution of one example of a heat circulator to be in a conventional image-forming apparatus.

Specifically, the conventional heat circulator includes a heat-receiving part 11 composed of plural metal members 22 that are aligned in parallel with each other (this part 11 is to receive the heat from the high-temperature belt 21*a*); a heat-radiating part 12 which transfers the thus-received heat to the low-temperature belt 21*b;* and plural, closed cylindrical heat pipes 13 that connect the metal members 22 of the heat-receiving part 11 to those of the heat-radiating part 12, as described hereinabove with reference to FIG. 15. In this, the metal members 22 of the heat-receiving part 11 and those of the heat-radiating part 12 are integrated by brazing (25) the side surfaces of the neighboring members 22. The surfaces of the thus-formed heat-receiving part 11 and heat-radiating part 12 that are to come into contact with the belt running therearound are so cut and polished that they are gently curved to have a radius of curvature of from 300 mm to 2000 mm in order to ensure good contact of the surfaces with the belt. In this case, the level difference between the neighboring metal members must be at most 100 $\mu$m so as to prevent the reduction in the heat exchange efficiency of the heat circulator. As so mentioned hereinabove, however, the work to cut and polish the surfaces takes a lot of time and requires much labor, therefore causing the increase in the cost for producing the structure.

In the conventional heat circulator, the plural metal members are worked to have the grooves 24, which are for increasing the heat insulation between the neighboring metal members 22.

In the heat insulator 30 of this embodiment of the invention, however, both the first metal member 32_1 and the second metal member 32_2 are made of a single metal plate. The reason why we the present inventors have made it possible to form the members out of a single metal plate is described below.

Figure 18:
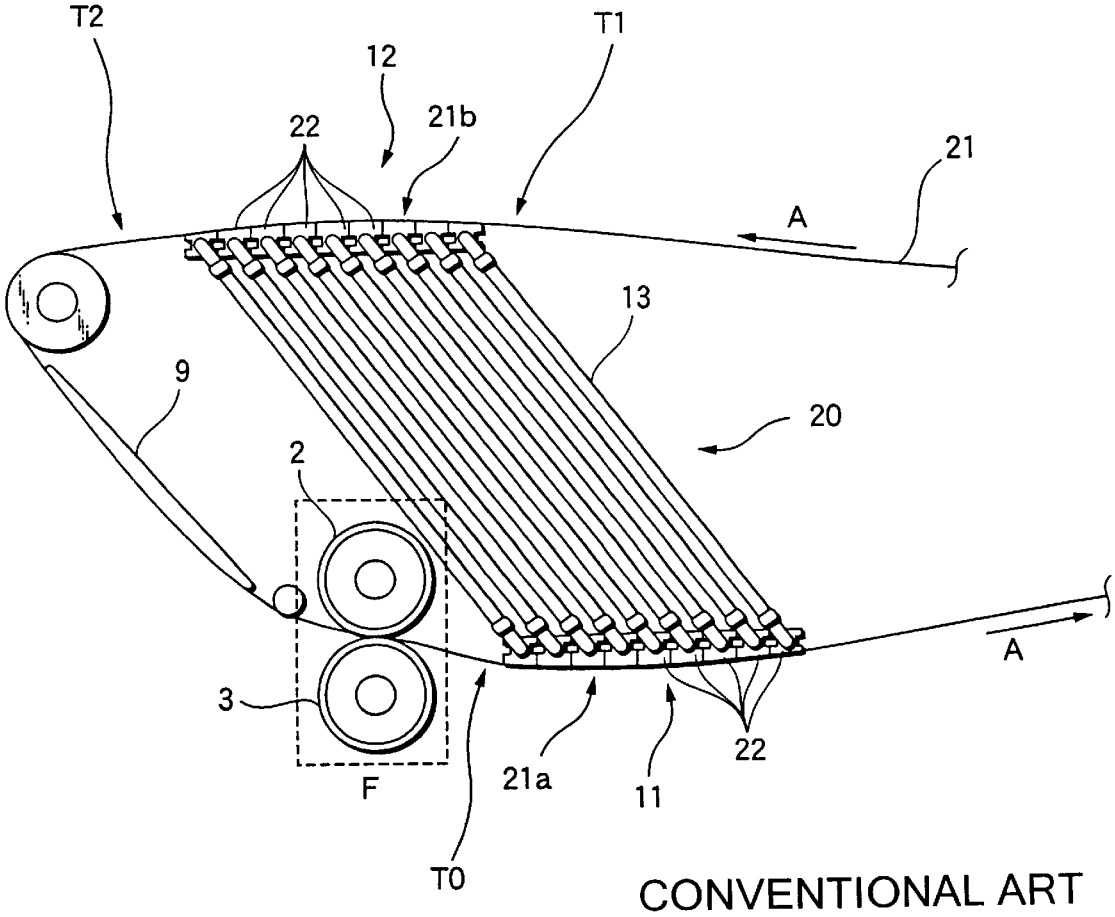
CONVENTIONAL ART FIG.18
FIG. 18 is a schematic view showing the outline of the constitution of an image-forming apparatus with the conventional heat circulator built therein.

The heat exchange efficiency of the conventional heat circulator 20 (see FIG. 18) may be defined as follows:

$$\text{Heat exchange efficiency}=(T2-T1)/(T0-T1)$$

wherein T0 indicates the surface temperature of the belt 21 just before into contact with the metal members 22 of the heat-radiating part 12; T1 indicates the temperature of the belt 21 just before into contact with the metal members 22 of the heat-receiving part 11; and T2 indicates the temperature of the belt 21 just after left from the metal members 22 of the heat-receiving part 11.

The conventional heat circulator 20 can realizes the defined heat exchange efficiency of from 0.5 to 0.6 or so. The belt temperature T1 is the surface temperature of the belt not brought into contact with the metal members. "Just before" and "just after" are meant to indicate that the running belt is at most 50 mm before or after the heat circulator.

We, the present inventors have assiduously studied the heat conduction inside the metal members of heat circulators, and, as a result, have reached the conclusion that, if the cross section of the metal members is controlled relative to the quantity of heat to be transferred from the first metal member to the belt that runs on the metal member, it could realize high heat exchange efficiency even though the metal members are not partitioned into plural sections thermally insulated from each other in the belt traveling direction. Specifically, we have reached the conclusion that, if the heat flux toward the belt is large, the heat flux inside the metal members could be reduced by suitably controlling the thickness of the metal members, even though the metal members are not partitioned into plural sections thermally insulated from each other, and, after all, the temperature difference inside the metal members is ensured to realize high heat exchange efficiency.

Based on the conclusion as above, we, the present inventors have tried a single metal plate for the two metal members 32_1, 32_2 to be in the image-forming apparatus as in FIG. 2, and tested the thus-constructed heat circulator for the heat exchange efficiency. The test condition we employed is mentioned below. Based on the test data we obtained, we have analyzed the relationship between the quantity of heat transferred from the second metal member 32_2 to the belt with high heat exchange efficiency, and the cross section of the metal members.

Thickness t of metal members: 1 mm, 2 mm, 3 mm, 5 mm

Width W1 of metal members in the widthwise direction of image bearing member: 350 mm, 150 mm Length L of metal members in the image bearing member-traveling direction: 45 mm, 110 mm, 220 mm Width W2 of image be member: 340 mm, 240 mm, 140 mm Traveling speed of image bearing member: 50 mm/sec, 100 mm/sec, 200 mm/sec, 300 mm/sec Number of heat pipes: 2, 5, 9

Material of the substrate of image bearing member: polyimide

Thickness of the substrate of image bearing member. 50 μm,

Material of the elastic layer of image bearing member: silicone rubber

Thickness of the elastic layer of image bearing member: 50 μm, 80 μm, 110 μm

Concretely, one example of the heat insulator 30 is so constructed that the thickness, t, of the metal members 32_1, 32_2 is 2 mm; the width, W1, of the metal members in the widthwise direction of the image bearing member is 350 mm; the length, L, of the metal members in the image bearing member-traveling direction is 220 mm; the width, W2, of the image bearing member 50 is 340 mm; and the number, n, of the heat pipes 33 is 9, as in FIG. 3 and FIG. 5. type of image bearing members 50 are prepared, of which the thickness of the elastic layer is 50, 80 and 110 μm. The traveling speed of each image beaming member 50 is varied to be 50, 100, 200 and 300 m/sec. As in FIG. 5, the temperature of the image bearing member 50 just before into contact with the first metal member 32_1 is designated by T0; the temperature of the image bearing member 50 just before into contact with the second metal member 32_2 is designated by T1; the temperature of the image bearing member 50 just 3 left from the second metal member 32_2 is designated by T2; and the temperature, bT, of the second metal member 32_2 at the downstream edge thereof relative to the traveling direction of the image bearing member is measured.

Figure 7:
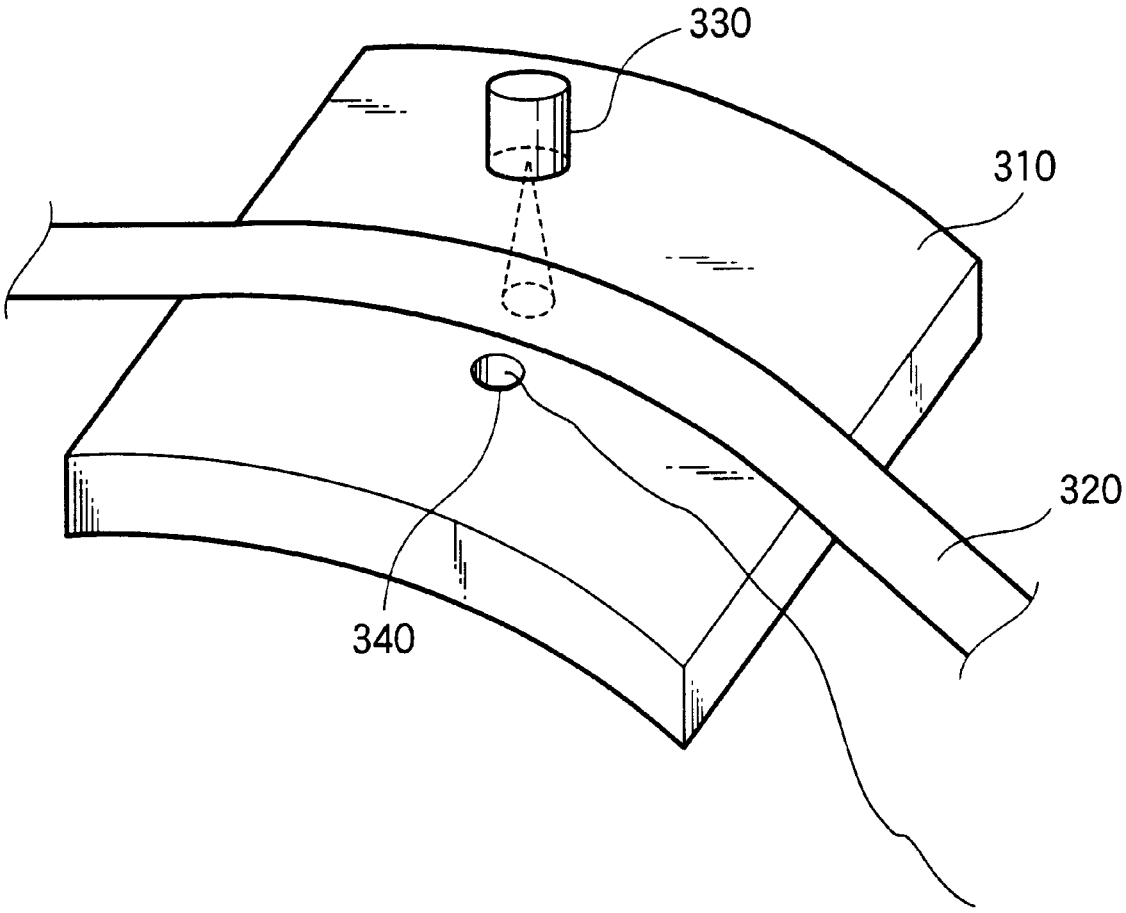
FIG. 7 is a perspective view showing a device for measuring the temperature of the intermediate transfer member built in the image-forming apparatus of FIG. 1.

FIG. 7 is a perspective view showing a device for measuring the temperature of the innate transfer member built in the image-forming apparatus of the embodiment illustrated.

As in FIG. 7, a non-contact IR thermometer 330 is used for measuring the temperature of the intermediate transfer member 320. The temperature is corrected as follows: An aluminium plate 310 is worked to have a curved surface. This is equipped with a heater on its back surface; and its thickness is 5 mm, and its width is 300 mm. A belt 320 having a width of 30 mm is prepared. This is made of the same material as that for the intermediate transfer member to be in the image-forming apparatus. The belt 320 is fitted under tension to the aluminium plate 310, nearly in the center of the aluminium plate 310. The temperature of the center area of the belt 320 is measured with the IR thermometer 330. A thermocouple 340 to measure the surface temperature of the aluminium plate 310 is fitted to the aluminium plate 310 in the area outside the side edge of the belt 320. In that condition, the radiation of the IR thermometer 330 is so controlled that the temperature indicated by the IR thermometer 330 is the same as that indicated by the thermocouple 340.

To measure the temperature, T0, of the intermediate transfer member just before into contact with the first metal member of the heat circulator, the temperature, T1, of the intermediate transfer member just before into contact with the second metal member of the heat circulator, and the temperature, T2, of the intermediate transfer member just after left from the second metal member of the heat circulator, used are thermocouples. To measure them, the thermocouples are disposed on the surface of the intermediate transfer member not brought into contact with the heat circulator, all in the center of that surface relative to the direction perpendicular to the intermediate transfer medium-traveling direction, spaced by 30 mm from the heat circulator.

To measure the temperature, bT, of the part A of the second metal member 32_2 of this embodiment shown in FIG. 3 and FIG. 5, or that is, the temperature of the second metal member 32_2 at the downstream edge thereof relative to the traveling direction of the intermediate transfer member, used is a thermocouple. To measure it, the thermocouple is attached to the side edge M of the second metal member 32_2, in the center thereof relative to the widthwise direction of the intermediate transfer member running over the metal member 32_2.

In the manner as above, various types of heat circulators are measured to obtain their data, while the thickness, t, of the metal members, the width, W1, of the heat circulator in the direction perpendicular to the image bearing member-traveling direction, the length, L, of the heat circulator in the image bearing member-traveling direction, the width, W2, of the image bearing member in the diction perpendicular to the image bearing member-traveling direction, and the number, n, of the heat pipes are all varied.

After having been thus measured, the heat circulators of which the heat exchange efficiency is higher than 0.5, or that is, higher than the heat exchange efficiency of the conventional heat circulator with plural metal members brazed and integrated are evaluated good (O); and those of which the heat exchange efficiency is low are evaluated bad (x). We, the present inventors have fib analyzed the relationship between the heat exchange efficiency of the heat circulators tested and the thus-measured parameters thereof, and, as a result, have found that the cross section, t×(W1−W2), of the metal member not kept in contact with the image bearing member, and the ratio, (T2−T1)/(bT−T1), of the quantity of heat transferred from the second metal member to the belt (image bearing member) to the temperature difference in different areas of the second metal member have a specific relationship mentioned below.

Figure 8:
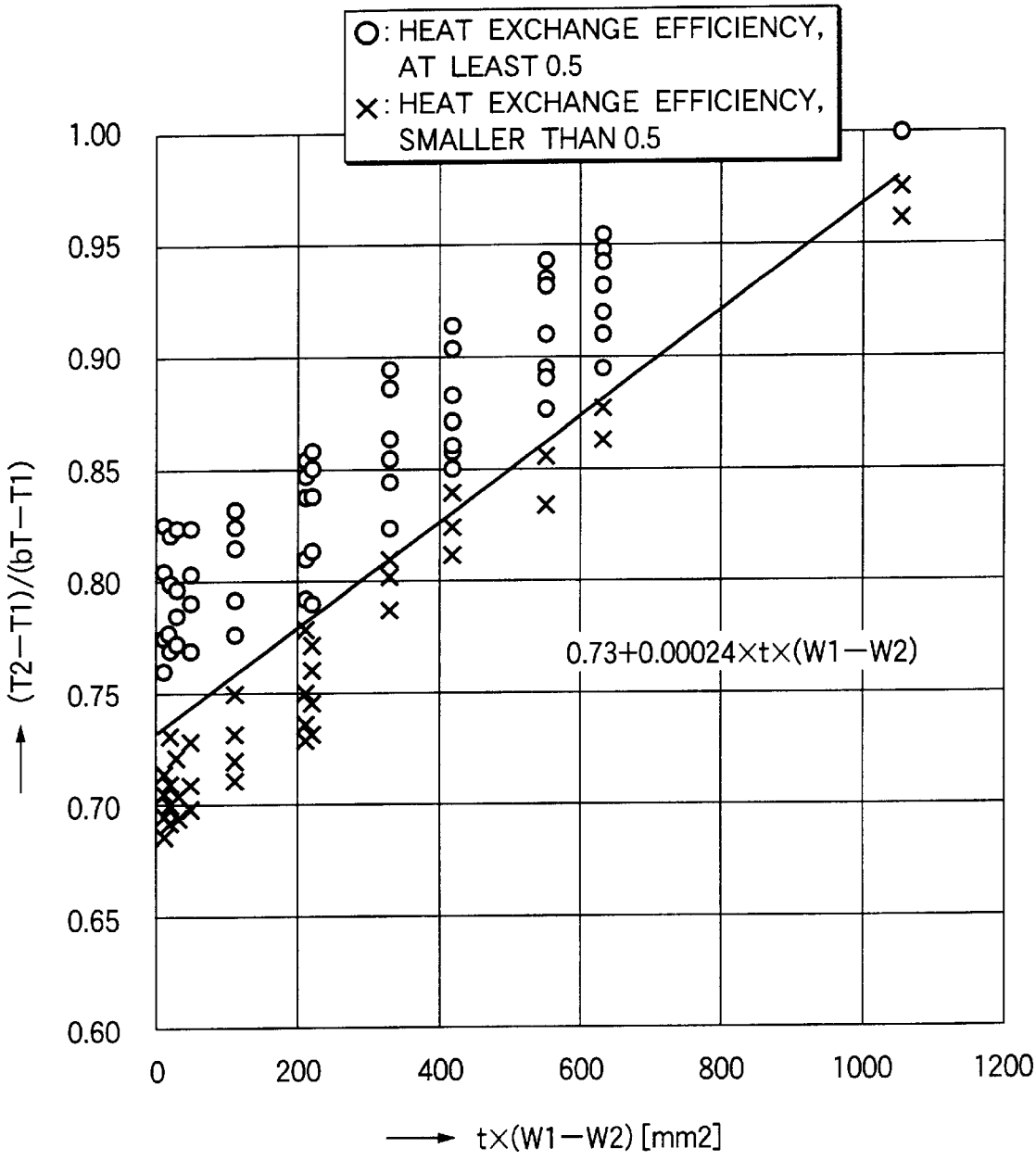
FIG. 8 is a graph showing the relationship between the cross section of the metal members not kept in contact with the image bearing member, and the ratio of the quantity of heat transferred from the second metal member to the belt to the temperature difference in different areas of the second metal member.

FIG. 8 is a graph showing the relationship between the cross section of the metal members not kept in contact with the image bearing member, and the ratio of the quantity of heat transferred from the second metal member to the belt (image bearing member) to the temperature difference in different areas of the second metal member.

As in FIG. 8, the good heat circulators (O) of which the heat exchange efficiency is higher than 0.5, or that is, higher than the heat exchange efficiency of the conventional heat circulator are clearly differentiated from the heat circulator (x) of which the heat exchange efficiency is low.

From the data plotted in the graph, it is understood that the relationship between the cross section, t×(W1−W2), of the metal member not kept in contact with the image bearing member, and the ratio, (T2−T1)/(bT−T1), of the quantity of heat transferred from the second metal member to the belt (image bearing member) to the temperature difference in different areas of the second metal member that satisfies the following formula (1) ensures good heat exchange efficiency of at least 0.5.

$$0.73+0.00024\times t\times(W1-W2)\leqq(T2-T1)/(bT-T1) \quad (1)$$

When the thickness of the metal members of the heat circulator, the size of the heat circulator and the temperatures of the predetermined sites of the metal members relative to the image bearing member that runs over the heat circulator are so defined that their data satisfy the formula (1), then the circulator ensures good heat exchange efficiency even when the metal members therein are made of a single metal plate.

As so mentioned hereinabove, the conventional heat circulator (see FIG. 16) is fabricated by inserting heat pipes into the through-holes of plural metal members, then brazing and integrating the plural metal members with a solder, and finally cutting and polishing the thus-integrated metal members. However, when two tabular metal members are specifically worked to satisfy the formula (1) in fabricating heat circulators, the heat circulators enjoy high heat exchange efficiency. The metal members can be readily produced through pultrusion, and plural heat pipes can be fitted thereto with ease, as in FIG. 4. In the process of producing the metal members, the step of inserting heat pipes into the through-holes of plural metal members and the step of brazing the plural metal members that are indispensable in the conventional art can be omitted. In addition, when the surface profile of the mold to be used in producing the metal members is appropriately controlled, the step of cutting and polishing the metal members produced may be omitted. In the invention, many working steps can be omitted, and the production costs can be reduced.

In the embodiment illustrated, the metal members made of a single metal plate ensure satisfactory mechanical strength of the heat circulator. Therefore, in the heat circulator, the lower edges of the metal members tat must be brazed in the conventional art may be omitted, and the heat pipes may be fitted to the metal members in a simplified manner by merely clamping them.

Next described are the results and the data of the wall thickness and the profile of the pockets of the metal members that surround the heat pipes fitted thereto.

Metal members are made of a single metal plate, and various heat circulators including them are tested for heat exchange efficiency under the condition mentioned below. The pocket angle θ (see FIG. 6) of the pockets 35 is varied to be 360 degrees, 280 degrees, 220 degrees, 180 degrees and 140 degrees; and the wall thickness, tf, of the pockets 35 is varied to be 0.75 mm, 1.0 mm, 1.5 mm and 2.5 mm.

Thickness t of metal members: 1 mm, 3 mm

Width W1 of metal members in the widthwise direction of image bearing member: 350 mm Length L of metal members in the image bearing member-traveling direction: 220 mm Width W2 of image bearing member: 340 mm Traveling speed of image bearing member: 200 mm/sec Number of heat pipes: 9

Material of the subsume of image bearing member: polyimide

Thickness of the substrate of image berg member: 50 μm

Material of the elastic layer of image bearing member: silicone rubber

Thickness of the elastic layer of image bearing member: 80 μm

Figure 9A:
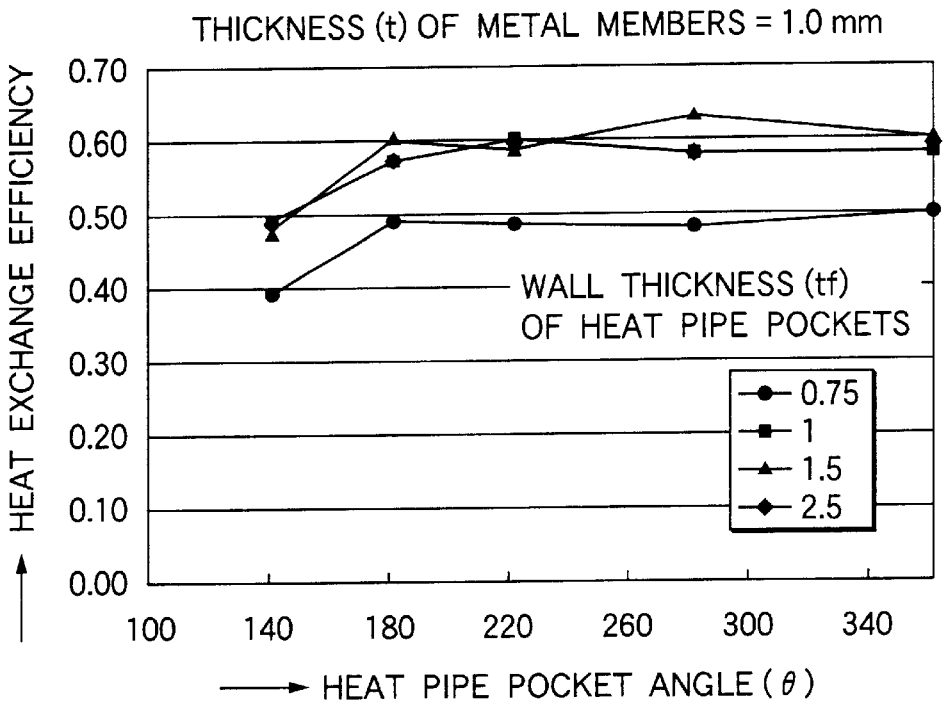
FIG. 9A and FIG. 9B are graphs showing the relationship between the pocket angle θ of the heat pipe pockets of metal members, and the heat exchange efficiency of heat circulators
Figure 9B:
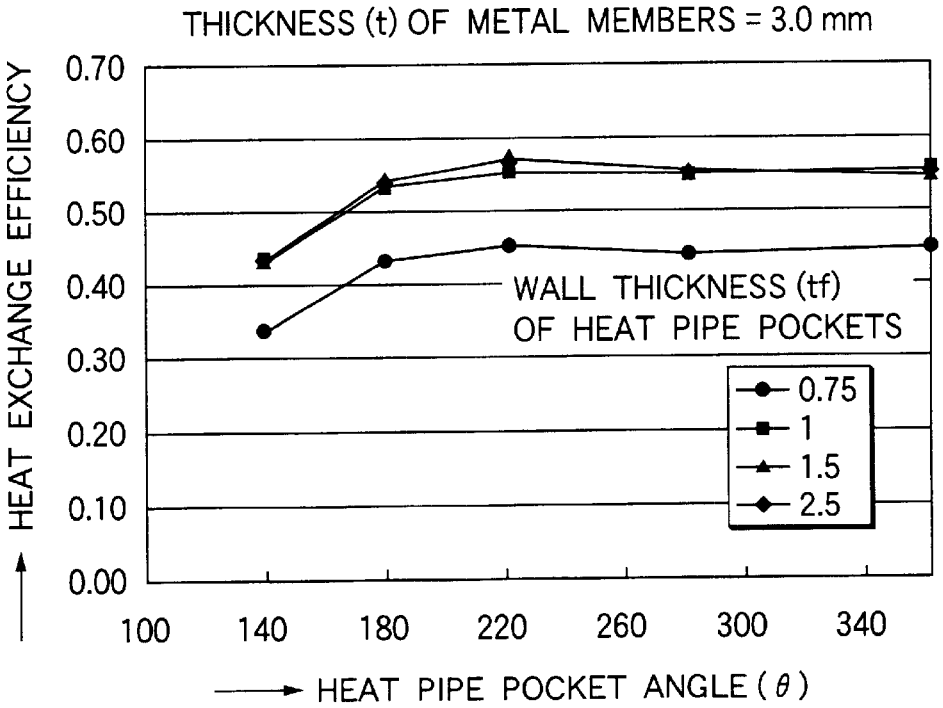

FIG. 9A and FIG. 9B are graphs showing the relationship between the pocket angle θ of the heat pipe pockets of metal members, and the heat exchange efficiency of heat insulators.

As in FIG. 9A and FIG. 9B, it is understood that the heat exchange efficiency of the heat circulators tested greatly lowers when the pocket angle θ is smaller than 180 degrees, not depending on the thickness, t, of the metal members and the wall thickness, tf, of the pockets.

Figure 10A:
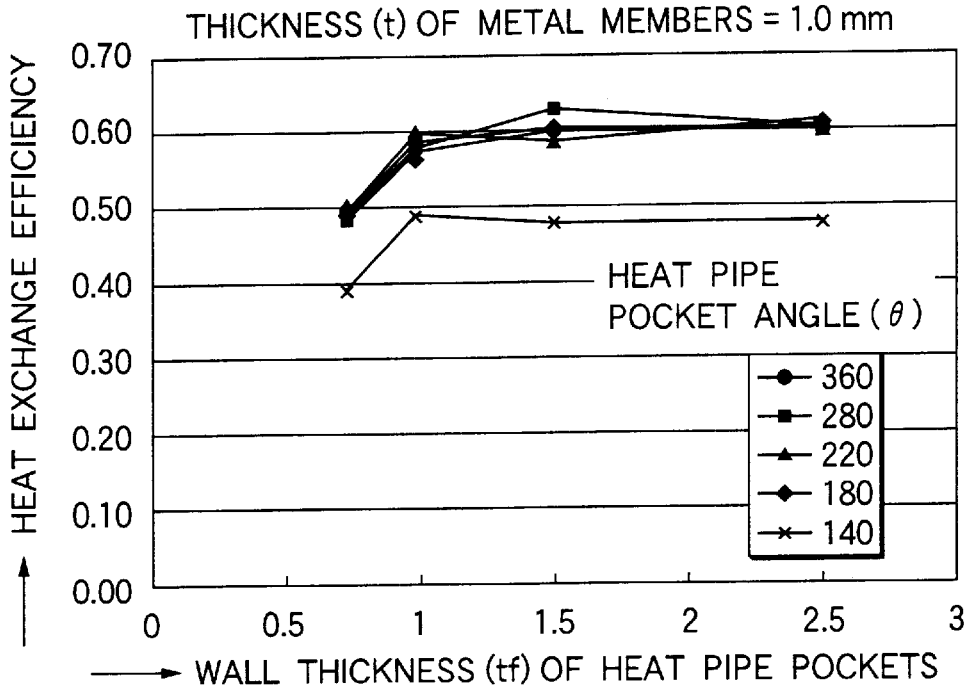
FIG. 10A and FIG. 10B are graphs showing the relationship between the wall thickness of the heat pipe pockets of metal members, and the heat exchange efficiency of heat circulators.
Figure 10B:
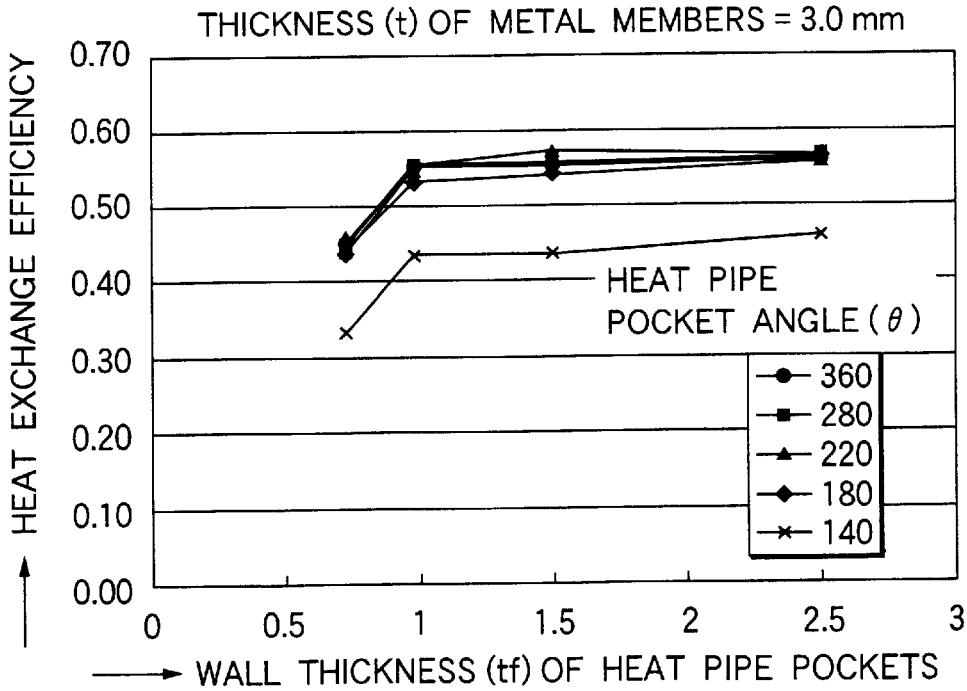

FIG. 10A and FIG. 10B are graphs showing the relationship between the wall thickness of the heat pipe pockets of metal members, and the heat exchange efficiency of heat circulators.

As in FIG. 10A and FIG. 10B, it is understood that the heat exchange efficiency of the heat circulars tested greatly lowers when the wall thickness, tf, of the pockets is smaller than 1 mm, not depending on the thickness, t, of the metal members and the pocket angle θ.

As in the above, when the pocket angle θ for heat pipes is not smaller than 180 degrees and when the wall thickness, tf, of the pockets is not smaller than 1.0 mm, the heat pipes efficiently transfer the heat from one metal member to the other and realize good heat exchange efficiency.

When the pocket angle is 200 degrees or so and when the wall thickness of the pockets is 1.5 mm or so, the heat pipes can be well clamped, not requiring the step of inserting them into through-holes of metal members and the step of brazing the metal members by soldering them that arm indispensable for conventional heat circulators. Therefore, the production costs of the heat circulator of the invention can be reduced.

Next described is one example of this embodiment of the invention.

An image-forming apparatus of the type of FIG. 1 was constructed, in which the recording paper P used is Fuji Xerox's J paper, and the screen is a vertical multi-line screen with 200 lines. The traveling speed of the intermediate transfer member 50 therein (this is the transfer and fixing speed in the apparatus) is 260 mm/sec. Under different conditions, 500 sheets of plain paper (J paper) were printed, and the heat exchange efficiency of the heat circulation system in the apparatus was measured in every case.

The data thus measured gave the following result, when T0 is 130 degrees, T1 is 50 degrees, T2 is 94 degrees and bT is 107 degrees, $$0.73+0.00024\times t\times(W1-W2)=0.73+0.00024\times 2\times(350-340)=0.7348;$$

$$(T2-T1)/(bT-T1)=(94-50)/(107-50)=0.77.$$

This satisfies the above-mentioned formula (1), $$0.73+0.00024\times t\times(W1-W2)\leqq(T2-T1)/(bT-T1).$$

The heat exchange efficiency in this case is:

$$(T2-T1)/(T0-T1)=(94-50)/(130-50)=0.55,$$

and is good.

Next described is another embodiment of the invention.

Figure 11:
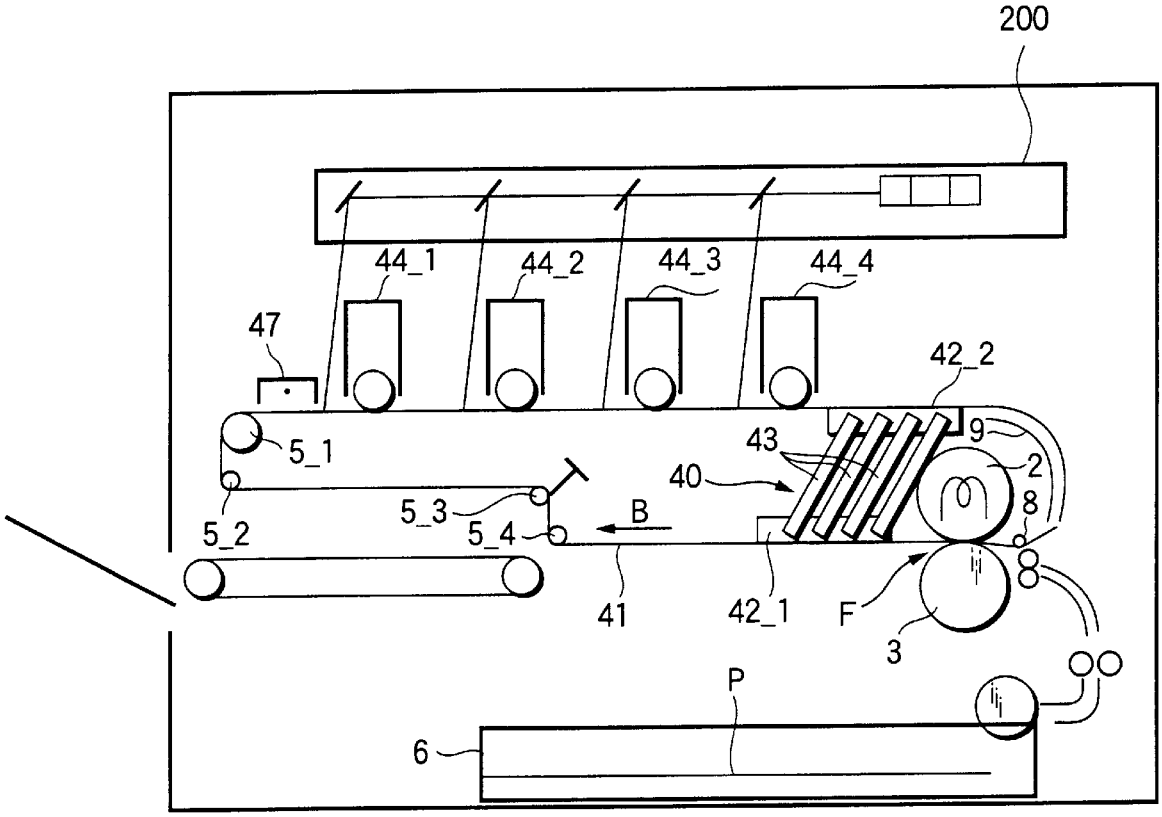
FIG. 11 is a schematic view showing the outline of the constitution of another embodiment of the image-forming apparatus of the invention.

FIG. 11 is a schematic view showing the outline of the constitution of another embodiment of the image-forming apparatus of the invention.

This is to concretely illustrate another embodiment of the image-forming apparatus of the invention.

As in FIG. 11, the image-forming apparatus includes an endless belt-type photoreceptor 41 that circulates and moves in the direction of the arrow B, while carrying, on its surface, an electrostatic latent image and a toner image formed by developing the latent image, and transports the toner image to the simultaneous transfer and fixing zone F; a recording medium-transporting system for transporting recording paper P to the simultaneous transfer and fixing zone F in accordance with the timing of the photoreceptor 41 to transport the toner image thereon to that zone F; a heating roll 2 and a pressure roll 3 between which the toner image on the photoreceptor 41 having been transported to the simultaneous transfer and fixing zone F is heated while the recording paper P having been transported to that zone F is laid over the photoreceptor 41 with the toner image being sandwiched therebetween and pressed against the photoreceptor 41 so that the toner image on the photoreceptor 41 is transferred and fixed on the recording paper P; and a heat circulator 40 that comes into contact with the running photoreceptor 41 at positions both upstream and downstream of the simultaneous transfer and fixing zone F in the traveling direction of the photoreceptor 41 so that the heat of the photoreceptor 41 downstream of the simultaneous transfer and fixing zone F is transferred to the part of the photoreceptor 41 upstream of that zone F.

The heat circulator 40 includes two tabular metal members 42_1, 42_1 that come into contact with the photoreceptor 41 at positions upstream and downstream of the simultaneous transfer and fixing zone F; and plural graphite sheets 43 bonded to both the two metal members 42_1, 42_1 and aligned in the longitudinal direction of the photoreceptor 41 so that the heat of the first metal member 42_1 disposed downstream of the simultaneous transfer and fixing zone F is transferred to the second metal member 42_2 disposed upstream of that zone F. In this, the two metal members 42_1, 42_2 are the same as those in the first embodiment described hereinabove, and the heat circulator 40 is so controlled that it satisfies the above-mentioned formula (1).

In this embodiment, the photoreceptor 41 corresponds to the image bearing member referred to herein; the heating roll 2 and the pressure roll 3 correspond to the simultaneous transfer and fixing system referred to herein; the graphite sheets 43 correspond to the heat-transporting members referred to herein; and the recording paper P corresponds to the sheet-like recording medium referred to herein.

In addition, the image-forming apparatus of this embodiment includes a charger 47 that uniformly charges the surface of the photoreceptor 41; a beam scanner 200 which is switched on and off by a beam pulse width modulator to thereby expose the uniformly-charged photoreceptor 41 to light corresponding to the intended colors of black yellow, magenta and cyan; and developer units 44_1, 44_2, 44_3, 44_4 that develop the electrostatic latent images of such colors formed on the photoreceptor 41 by the beam scanner 200, with the respective toners to form the toner images of the corresponding colors.

The apparatus further includes rolls 5_1, 5_2, 5_3, 5_4 to support the photoreceptor 41, a heating plate 9 to heat the photoreceptor 41, a curvature-reversing roll 8, and a ray 6 to house recording paper P, and these are the same as those in the image-forming apparatus of the embodiment of FIG. 1.

In the image-forming apparatus of this embodiment, the surface of the photoreceptor 41 that rotates in the direction of the arrow B is uniformly charged by the charger 47, and then exposed to the light from the beam scanner 200 thereby to have electrostatic latent images of the intended colors of black, yellow, magenta and cyan formed thereon. The thus-formed electrostatic latent images are developed by the corresponding toners of black, yellow, magenta and cyan housed in the developer units 44_1, 44_2, 44_3, 44_4, whereby is formed a multi-color toner image of plural toner images of those colors, on the photoreceptor 41.

Held on the photoreceptor 41 that moves in the direction of the arrow B, the multi-color toner image reaches the site of the second metal member 42_2 of the heat circulator 40, and is heated by the second metal member 42_2. Then, this reaches the heating plate 9 and is heated by it, and is thus fused.

The heat circulator 40 includes the tabular second metal member 42_2 that comes into contact with the photoreceptor 41 at a position upstream of the simultaneous transfer and fixing zone F; the tabular first metal member 42_1 that comes into contact with the photoreceptor 41 at a position downstream of that zone F; and plural graphite sheets 43 bonded to both the two metal members 42_1, 42_2 and aligned in the longitudinal direction of the photoreceptor 41 so that the heat of the first metal member 42_1 is transfer to the second metal member 42_2.

The fist metal member 42_1 of the heat circulator 40 is to receive the heat of the photoreceptor 41 running forward from the simultaneous transfer and fixing zone F along with the multi-color toner image formed thereon and along with the recording paper P, and to cool them. With that the toner is coagulated and solidified to firmly adhere to the recording paper P.

The heat thus having been recovered by the first metal member 42_1 of the heat circulator 40 is then transferred to the second metal member 42_2 via the graphite sheets 43 that connect the first metal member 42_1 and the second metal member 42_2, and then returned to the photoreceptor 41 via the second metal member 42_2. In that manner, the heat of the photoreceptor 41 is prevented from being transferred to the photoreceptor cleaner and to the development unit, and therefore the toner is prevented from fusing in the photoreceptor cleaner and in the development unit. In the process, in addition, heat is recovered and recycled in that manner, and the energy necessary in the image-forming cycle can be saved.

As described hereinabove, the heat circulator 40 in this embodiment includes the fist and second metal members each made of a single metal plate, like that in the first embodiment described in the previous section, but the heat-transporting members in this are graphite sheets and not heat pipes.

Figure 12:
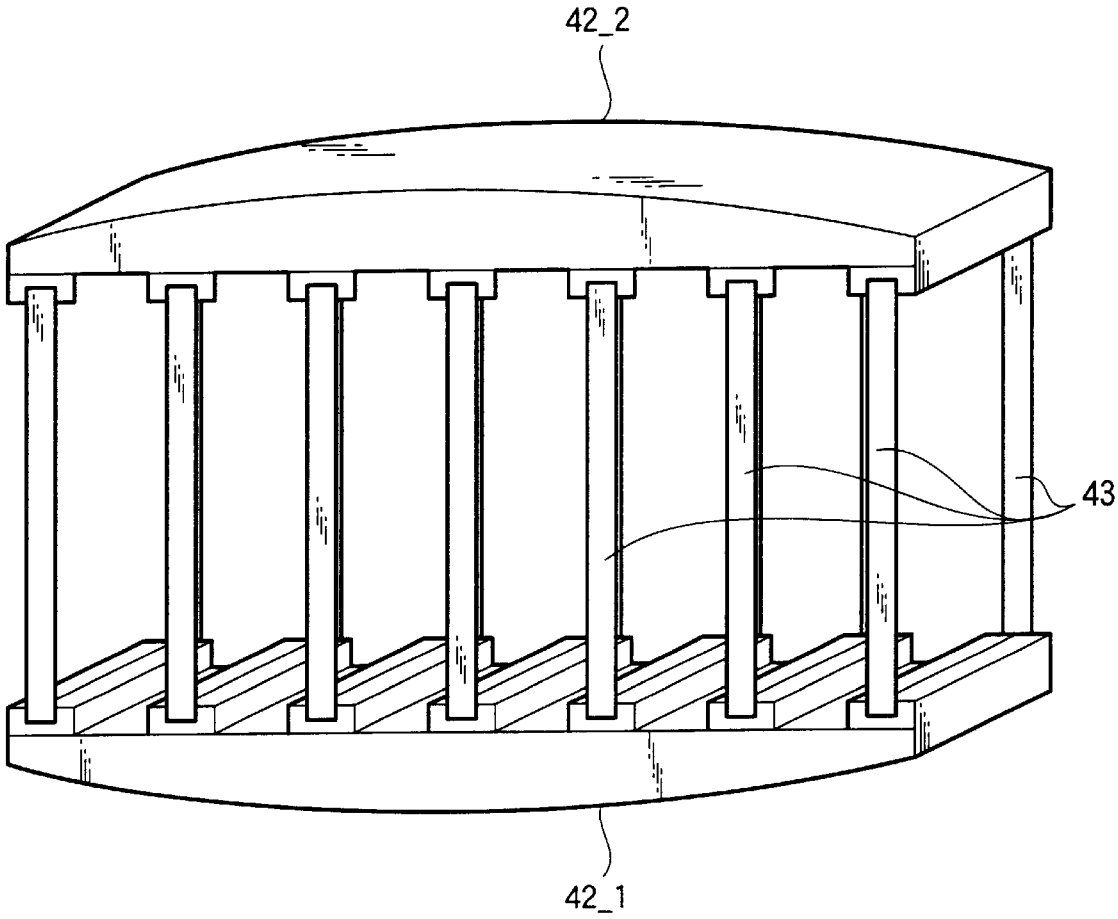
FIG. 12 is a schematic view showing the outline of the constitution of the heat circulation system of the invention built in the image-forming apparatus of FIG. 11.
Figure 13:
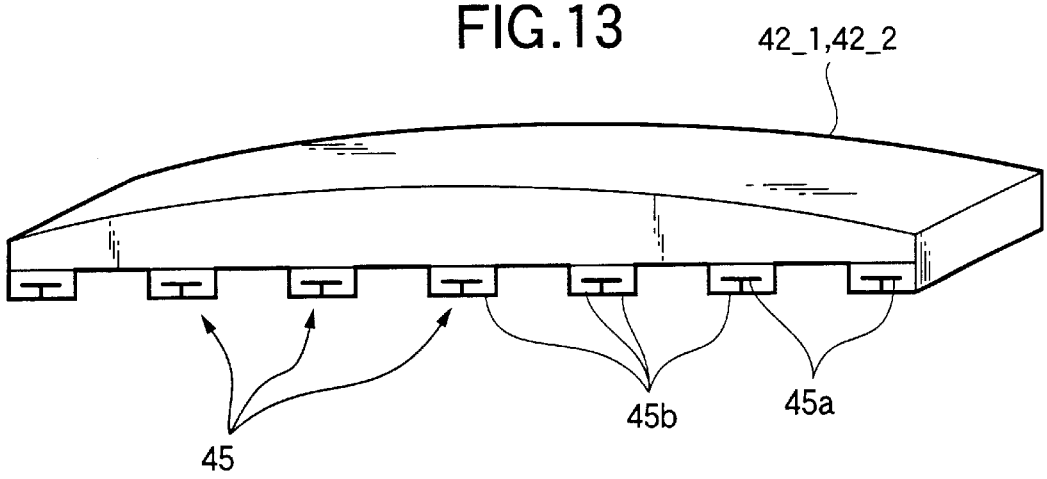
FIG. 13 is an outline view showing the metal member to be in the image-forming apparatus of FIG. 11.

FIG. 12 is a schematic view showing the outline of the constitution of the heat circulator built in the image-forming apparatus of this embodiment, and FIG. 13 is an outline view showing the metal member to be in the heat circulator of FIG. 12.

The graphite sheets 43 that connect the first and second metal members 42_1, 42_2 and act as the heat-transporting members each have a thickness of about 100 $\mu$m and a width of 10 mm. Like the heat pipes in the other embodiment, the graphite sheets 43 are also fitted to the first and second metal members 42_1, 42_2 by clamping them.

As in FIG. 13, the back surface, opposite to the surface thereof to come into contact with the photoreceptor 41, of the first and second metal members 42_1, 42_2 is so worked that it has plural graphite sheet-supporting mechanisms 45 for supporting a graphite sheet 43, and every graphite sheet 43 is inserted into the groove 45*a* of each graphite sheet-supporting mechanism 45. With that, every tip 45*b* of each mechanism 45 is clamped to thereby fix all the graphite sheets 43 to the first and second metal members 42_1, 42_2. The width W1 of these two metal members in the widthwise direction of the photoreceptor is 350 mm; the length L thereof in the longitudinal direction of the photoreceptor is 220 mm; and the thickness, t, of each metal member between the neighboring graphite sheets is 2 mm.

For the photoreceptor 41 in this embodiment, usable are any of heat-resistant photoreceptors of Se, a-Si, a-SiC, CdS or the like. In this embodiment, the photoreceptor 41 has a width of 240 mm.

The toners in this embodiment arc the same as those in the first embodiment; and the toner dose of each color to recording paper is 0.65 mg/cm$^2$ like in the first embodiment.

The heating plate 9 in his embodiment is the same as that in the first embodiment.

The heating roll and the pressure roll in this embodiment are the same as those in the first embodiment.

The recording paper P in this embodiment is Fuji Xerox's J paper, like in the first embodiment.

The screen in this embodiment is a vertical multi-line screen with 200 lines, like in the first embodiment.

The temperature of each site in the apparatus of this embodiment is measured in the same manner as in the first embodiment.

One example of the image-forming apparatus of this embodiment was constructed, in which the traveling speed of the photoreceptor with toner images formed thereon (this is the transfer and fixing speed in the apparatus) is 260 mm/sec. Under different conditions, 500 sheets of plain paper (J paper) were printed, and the heat exchange efficiency of the heat circulation system in the apparatus was measured in every case.

The data thus measured gave the following result, when T0 is 120 degrees, T1 is 45 degrees, T2 is 84 degrees and bT is 94 degrees.

$$0.73+0.00024\times t\times(W1-W2)=0.73+0.00024\times 2\times(350-240)=0.7828;$$

$$(T2-T1)/(bT-T1)=(84-45)/(94-45)=0.79.$$

This satisfies the above-mentioned formula (1), $$0.73+0.00024\times t\times(W1-W2)\leqq(T2-T1)/(bT-T1).$$

The heat exchange efficiency in this case is:

$$(T2-T1)/(T0-T1)=(84-45)/(120-45)=0.52,$$

and is good.

Next described is another aspect of the invention, relating to a fixing unit.

Figure 14:
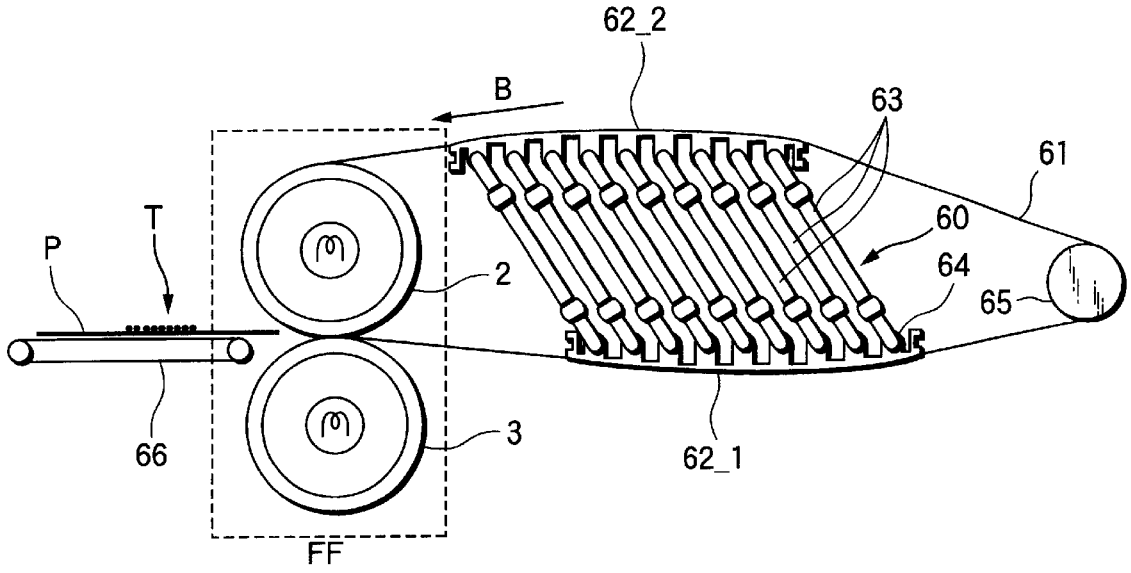
FIG. 14 is a schematic view showing the outline of the constitution of one embodiment of the fixing unit of the invention.

FIG. 14 is a schematic view showing the outline of the constitution of one embodiment of the fixing unit of the invention.

The fixing unit is for the image-forming apparatus of the invention described hereinabove.

As in FIG. 14, the fixing unit includes an endless belt-type fixing member 61 that circulates and moves via the fixing zone FF; a recording medium conveyor belt 66 that conveys a sheet-like recording medium P with a toner image T formed thereon to the fixing zone FF; a heating roll 2 and a pressure roll 3 between which the toner image T on the recording medium P having been transported to the fixing zone FF is sandwiched between the recording medium P and the fixing member 61 and is heated under pressure; and a heat circulator 60 that comes into contact with the running fixing member 61 at positions both upstream and downstream of the fixing zone FF in the traveling direction of the fixing member 61 so that the beat of the fixing member 61 downstream of the fixing zone FF is transferred to the part of the fixing member 61 upstream of that zone FF.

In this embodiment, the heating roll 2 and the pressure roll 3 correspond to the heating and pressing unit referred to herein; and the recording medium conveyor belt 66 corresponds to the recording medium-transporting system referred to herein.

The heat circulator 60 includes two tabular metal members 62_2, 62_1 that come into contact with the fixing member 61 at positions upstream and downstream of the fixing zone FF; and plural heat pipes 63 bonded to the two metal members 62_1, 62_2 and aligned in the longitudinal direction of the fixing member 61 so that the heat of the first metal member 62_1 disposed downstream of the fixing zone FF is transferred to the second metal member 62_2 disposed upstream of the fixing zone FF. The metal members 62_1, 62_2 have pockets 64 all extending in the widthwise direction of the fixing member 61. The beat pipes 63 are separately inserted into these pockets 64. Each pocket 64 has a wall thickness of at least 1.0 mm, and the pocket angle to surround each heat pipe 63 is at least 180 degrees.

As in FIG. 14, the fixing member 61 circulates and moves in the direction of the arrow B, while supported and guided by the heating roll 2 and the recording paper separation roll 65. Recording paper P with a toner image T formed thereon in a known electrophotographic image-forming apparatus (not shown) is conveyed by the recording medium conveyor belt 66 to the fixing zone FF. In the fixing zone FF, the heating roll 2 is positioned to be in contact with the pressure roll 3, and the fixing member 61 combined with the recording paper P with the toner image T thereon passes between the two rolls and is pressed by the pressure roll 3 against the heating roll 2.

The toner image T on the recording paper P is heated under pressure by the heating roll 2 and the pressure roll 3, and fixed on the recording paper P. After the image has been thus fixed thereon, the recording paper P further moves toward the roll 65 along with the fixing member 61. In this stage, the recording paper P and the fixing member 61 give their heat to the first metal member 62_1 of the heat circulator 60. Having thus reached the roll 65, the recording paper P is then separated from the fixing member 61 as it is pliable and tough and as the roll 65 has a small radius of curvature. Through the process, the image formation on the recording paper P is finished.

Having a width of 240 mm, The fixing member 61 is supported and guided by the two rolls 2, 65 under tension of 6 kgf.

In this embodiment, the fixing member 61 has a two-layered structure composed of a base layer and a surface layer. The base layer is made of a polyimide film having a thickness of 50 $\mu$m; and the surface layer is made of a silicone copolymer having a rubber hardness of 24 degrees and a thickness of 30 $\mu$m. The base layer may be a highly heat-resistant sheet having, for example, a thickness of from 10 $\mu$m to 100 $\mu$m; and the surface layer may be a releasable resin layer having, for example, a thickness of from 1 $\mu$m to 100 $\mu$m.

For the heating roll 2, used is a metal roll coated with a heat-resistant elastic layer of silicone rubber or the like; and a heat source is disposed inside the heating roll 2. In this embodiment, an aluminium hollow roll coated with a 2.0 mm-thick silicone rubber layer having a hardness of 30 degrees is used for the heating roll 2. Its outer diameter is 50 mm. A halogen lamp is used for the heat source to be inside the heating roll 2.

The pressure roll 3 may have the same constitution as that of the heating roll 2. In this embodiment, the two rolls 2 and 3 are the same. Also inside the pressure roll 3, disposed is a halogen lamp serving as a heat source. The nip width formed by the heating roll 2 and the pressure roll 3 is controlled to be 8.0 mm by controlling the pressing force of the heating roll 2 and the pressure roll 3 against each other.

In this embodiment, the pressure roll 3 is used for the pressure member in the fixing zone FF. However, the pressure member is not limited to only the pressure roll 3, but may be any one capable of uniformly pressing the fixing member 61 and the recording paper P against the heating roll 2 with no pressing failure to cause separation or slipping of the two. For example, a fixed pad may be pressed against the fixing member 61.

The constitution of the heat circulator 60 in this embodiment may be the same as that used in the image-forming apparatus described hereinabove. Concretely, the heat circulator 60 is so constituted that its first metal member 62_1 comes into contact with the fixing member 61 at a position downstream of the fixing zone FF and its second metal member 62_2 comes into contact with it at a position upstream of the fixing zone FF.

In this embodiment, the heat pipes 63 serve as the heat-transporting members; the width W1 of the metal members 62_1, 62_2 in the widthwise direction of the fixing member is 250 mm; the length L thereof in the fixing member-traveling direction is 100 mm; and the thickness, t, of the metal members 62_1, 62_2 between the neighboring heat pipes is 1.5 mm.

The pocket angle θ for each heat pipe is 350 degrees; and the wall thickness, tf, of each pocket 64 is 1.5 mm.

The temperature of each site in the fixing unit of this embodiment is measured in the same manner as in the embodiment of the image-forming apparatus described hereinabove.

One example of the fixing unit of this embodiment was constructed, in which the traveling speed of the fixing member 61 (this is the fixing speed in this unit) is 120 mm/sec. Under different conditions, 500 sheets of plain paper (J paper) were printed, and the heat exchange efficiency of the heat circulation system in this unit was measured in every case.

The data thus measured gave the following result, when T0 is 160 degrees, T1 is 60 degrees, T2 is 118 degrees and bT is 132 degrees.

$$0.73+0.00024\times t\times(W1-W2)=0.73+0.00024\times 15(250-240)=0.7336;$$

$$(T2-T1)/(bT-T1)=(118-60)/(132-60)=0.80.$$

This satisfies the above-mentioned formula (1), $$0.73+0.00024\times t\times(W1-W2)\leqq(T2-T1)/(bT-T1).$$

The heat exchange efficiency in this case is:

$$(T2-T1)/(T0-T1)=(118-60)/(160-60)=0.58,$$

and is good.

As described in detail hereinabove with reference to its preferred embodiments, the image-forming apparatus of the invention includes a heat circulator having two metal members both made of one metal plate, and not a conventional heat circulator including plural metal members that are thermally insulated from each other. In the image-forming apparatus of the invention, the heat circulator ensures high heat exchange efficiency and has high mechanical strength.

Like the image-forming apparatus, the fixing unit of the invention includes a heat circulator having two metal members both made of one metal plate, and not a conventional heat circulator including plural metal member that are thermally insulated from each other. In the fixing unit of the invention, the heat circulator ensures high heat exchange efficiency and has high mechanical strength.

The heat circulation system of the invention does not require the time-consuming and expensive work of cutting and polishing metal members, which, however, is indispensable in fabricating conventional heat circulators. Therefore, the production costs for fabricating the heat circulator of the invention can be significantly reduced.

While the invention has been described in detail and with reference to specific embodiments thereof, it will be apparent to one skilled in the art that various changes and modifications can be made therein without departing from the spirit and scope thereof.

The entire disclosure of Japanese Patent Application No. 2000-286605 filed on Sep. 21, 2000 including specification, claims, drawings and abstract is incorporated herein by reference in its entirety.

What is claimed is:

1. An image-forming apparatus, comprising.

an endless image bearing member that moves while carrying a toner image formed on the endless image bearing member;

a heating unit disposed in a traveling route of the endless image bearing member;

a first metal member that comes into contact with the endless image bearing member at a position downstream of the heating unit in the traveling direction of the endless image bearing member;

a second metal member that comes into contact with the endless image bearing member at positions downstream of the first metal member and upstream of the heating unit in the traveling direction of the endless image bearing member; and plural heat-transporting members aligned in the traveling direction of the endless image bearing member and clamped between the first and second metal members, wherein the image forming apparatus satisfies the relationship:

$$0.73+0.00024\times t\times(W1-W2)\leqq(T2-T1)/(bT-T1)$$

wherein:

t indicates the thickness of the individual first and second metal members,

W1 indicates the width of the individual first and second metal members in the widthwise direction of the endless image bearing member, W2 indicates the width of the endless image bearing member, bT indicates the temperature of the second metal member at the downstream edge of the second metal member relative to the traveling direction of the endless image bearing member, T1 indicates the temperature of the endless image bearing member just before coming into contact with the second metal member, and T2 indicates the temperature of the endless image bearing member just after the image bearing member leaves the second metal member.

2. The image-forming apparatus as claimed in claim 1, wherein the heat-transporting members are heat pipes.

3. The image-forming apparatus as claimed in claim 2, wherein at least one of the first or second metal member has a grasping mechanism that separately surrounds each heat pipe, the wall thickness of each heat pipe is at least 1 mm, and the pocket angle of the grasping mechanism is at least 180°.

4. An image-forming apparatus, comprising:

an endless image bearing member that moves while carrying a toner image formed on the endless image bearing member;

a heating unit disposed in a traveling route of the endless image bearing member;

a first metal member that comes into contact with the endless image bearing member at a position downstream of the heating unit in the traveling direction of the endless image bearing member;

a second metal member that comes into contact with the endless image bearing member at positions downstream of the first metal member and upstream of the heating unit in the traveling direction of the endless image bearing member; and plural heat-transporting members aligned in the traveling direction of the endless image bearing member and clamped between the first and second metal members, wherein the heat-transporting members are graphite sheets.

5. An image-forming apparatus, comprising:

an endless image bearing member that moves while carrying a toner image formed on the endless image bearing member;

a heating unit disposed in a traveling route of the endless image bearing member;

a first metal member that comes into contact with the endless image bearing member at a position downstream of the heating unit in the traveling direction of the endless image bearing member;

a second metal member that comes into contact with the endless image bearing member at positions downstream of the first metal member and upstream of the heating unit in the traveling direction of the endless image bearing member; and plural heat-transporting members aligned in the traveling direction of the endless image bearing member and clamped between the first and second metal members, wherein:

the heat-transporting members are heat pipes;

at least one of the first or second metal member has a grasping mechanism that separately surrounds each heat pipe, the wall thickness of each heat pipe is at least 1 mm, and the pocket angle of the grasping mechanism pipe is at least 180°.

6. A fixing unit, comprising:

a movable endless belt;

a heating unit that comes into contact with the movable endless belt to heat the movable endless belt;

a first metal member that comes into contact with the movable endless belt at a position downstream of the heating unit in the traveling direction of the movable endless belt;

a second metal member that comes into contact with the movable endless belt at positions downstream of the first metal member and upstream of the heating unit in the traveling direction of the movable endless belt; and plural heat-transporting members aligned in the traveling direction of the movable endless belt and clamped between the first and second metal members, wherein the fixing unit satisfies the relationship:

$$0.73+0.00024\times t\times(W1-W2)\leqq(T2-T1)/(bT-T1)$$

wherein:

t indicates the thickness of the individual first and second metal members,

W1 indicates the width of the individual first and second metal members in the widthwise direction of the movable endless belt, W2 indicates the width of the movable endless belt, bT indicates the temperature of the second metal member at the downstream edge of the second metal member relative to the traveling direction of the movable endless belt, T1 indicates the temperature of the movable endless belt just before the movable endless belt comes into contact with the second metal member, and T2 indicates the temperature of the movable endless belt just after the movable endless belt leaves the second metal member.

7. A fixing unit, comprising:

a movable endless belt;

a heating unit that comes into contact with the belt to heat the movable endless belt;

a first metal member that comes into contact with the movable endless belt at a position downstream of the heating unit in the traveling direction of the movable endless belt;

a second metal member that comes into contact with the movable endless belt at positions downstream of the first metal member and upstream of the heating unit in the traveling direction of the movable endless belt; and plural heat-transporting members aligned in the traveling direction of the movable endless belt and clamped between the first and second metal members, wherein:

the heat-transport member is a heat pipe, at least one of the first or second metal member has a grasping mechanism to separately surround each heat pipe, the wall thickness of each heat pipe is at least 1 mm, and the pocket angle of the grasping mechanism to surround each heat pipe is at least 180°.

8. A heat circulation system, comprising:

a movable endless belt;

a heating unit that comes into contact with the belt to heat the movable endless belt;

a pair of metal members that come into contact with the movable endless belt at positions upstream and downstream of the heating unit in a belt traveling direction; respectively, and plural heat-transporting members that connect the pair of metal members, wherein:

the heat of the movable endless belt downstream of the heating unit in the belt traveling direction is circulated to the part of the movable endless belt upstream of the heating unit; and the heat conversion system satisfies the relationship:

$$0.73+0.00024\times t\times(W1-W2)\geqq(T2-T1)/(bT-T1)$$

wherein:

t indicates the thickness of each metal member,

W1 indicates the width of each metal member in the widthwise direction of the movable endless belt, W2 indicates the width of the movable endless belt, bT indicates the temperature of the second metal member at the downstream edge of the second metal member relative to the traveling direction of the movable endless belt, T1 indicates the temperature of the movable endless belt just before the movable endless belt comes into contact with the second metal member, and T2 indicates the temperature of the movable endless belt just after the movable endless belt leaves the second metal member.

* * * * *